US012805674B2

(12) United States Patent
Bloomer et al.

(10) Patent No.: US 12,805,674 B2
(45) Date of Patent: Nov. 24, 2026

(54) SURFACE CLEANER

(71) Applicant: Techtronic Floor Care Technology Limited, Road Town (VG)

(72) Inventors: Ryan Bloomer, Charlotte, NC (US); Gregory Clark, Charlotte, NC (US); Joshua Craig, Mint Hill, NC (US); Nicholas Deblasio, Waxhaw, NC (US); Anthony Ferrigno, Mooresville, NC (US); Daniel Galleno, Charlotte, NC (US); Jeremy Hansen, Huntersville, NC (US); Felicia Head, Cincinnati, OH (US); Mathieu Lhoste-Clos, Charlotte, NC (US); Eslam El Zuwawi, Charlotte, NC (US)

(73) Assignee: TECHTRONIC FLOOR CARE TECHNOLOGY LIMITED, Tortola (VG)

( * ) Notice: Subject to any disclaimer, the term of this patent is extended or adjusted under 35 U.S.C. 154(b) by 374 days.

(21) Appl. No.: 18/570,794

(22) PCT Filed: Jun. 17, 2022

(86) PCT No.: PCT/US2022/033971

§ 371 (c)(1),
(2) Date: Dec. 15, 2023

(87) PCT Pub. No.: WO2022/266430

PCT Pub. Date: Dec. 22, 2022

(65) Prior Publication Data

US 2024/0277193 A1 Aug. 22, 2024

Related U.S. Application Data

(60) Provisional application No. 63/212,405, filed on Jun. 18, 2021.

(51) Int. Cl.
*A47L 5/22* (2006.01)
*A47L 5/30* (2006.01)
(Continued)

(52) U.S. Cl.
CPC ..... *A47L 5/225* (2013.01); *A47L 5/30* (2013.01); *A47L 5/362* (2013.01); *A47L 7/0019* (2013.01);
(Continued)

(58) Field of Classification Search
CPC . A47L 5/225; A47L 5/30; A47L 5/362; A47L 7/0019; A47L 7/0023;
(Continued)

(56) References Cited

U.S. PATENT DOCUMENTS 2,876,481 A 3/1959 Gerber et al.
4,955,106 A 9/1990 Stein et al.
(Continued)

FOREIGN PATENT DOCUMENTS

GB 2432303 A 5/2007

OTHER PUBLICATIONS

International Search Report and Written Opinion for Application No. PCT/US2022/033971 dated Nov. 22, 2022 (18 pages).

*Primary Examiner* — Andrew A Horton
(74) *Attorney, Agent, or Firm* — MICHAEL BEST & FRIEDRICH LLP

(57) ABSTRACT

A surface cleaner that includes an accessory body removably coupled to a base. A nozzle has a first nozzle portion having a first nozzle passageway attached to the base and a second nozzle portion having a second nozzle passageway attached to the accessory body and removable with the accessory body. The first nozzle portion and second nozzle portion are releasably coupled connecting the first and second nozzle passageways along an airpath in fluid communication with
(Continued)

a collection container when the accessory body is coupled to the base. The first nozzle passageway forms a suction inlet when the accessory body is coupled to the base and the second nozzle passageway forms the suction inlet in communication with the collection container and the suction source when the accessory body is uncoupled from the base.

17 Claims, 19 Drawing Sheets

(51) Int. Cl.

| | |
|---|---|
| ***A47L 5/36*** | (2006.01) |
| ***A47L 7/00*** | (2006.01) |
| ***A47L 9/04*** | (2006.01) |
| ***A47L 9/24*** | (2006.01) |
| ***A47L 11/34*** | (2006.01) |
| ***A47L 11/40*** | (2006.01) |

(52) U.S. Cl.
CPC ..... *A47L 7/0023* (2013.01); *A47L 7/0042* (2013.01); *A47L 9/0416* (2013.01); *A47L 9/0477* (2013.01); *A47L 9/248* (2013.01); *A47L 11/34* (2013.01); *A47L 11/4005* (2013.01); *A47L 11/4016* (2013.01); *A47L 11/4041* (2013.01); *A47L 11/4069* (2013.01); *A47L 11/4083* (2013.01); *A47L 11/4088* (2013.01)

(58) Field of Classification Search
CPC .... A47L 7/0042; A47L 9/0416; A47L 9/0477; A47L 9/248; A47L 11/34; A47L 11/4005; A47L 11/4016; A47L 11/4041; A47L 11/4069; A47L 11/4083; A47L 11/4088
See application file for complete search history.

(56) References Cited

U.S. PATENT DOCUMENTS

| | | | | |
|---|---|---|---|---|
| 5,341,541 | A * | 8/1994 | Sham | A47L 5/225 68/222 |
| 5,504,970 | A | 4/1996 | Neshat et al. | |
| 6,226,832 | B1 * | 5/2001 | McCormick | A47L 9/30 15/389 |
| 6,497,001 | B2 | 12/2002 | Di Nunzio et al. | |
| 7,131,164 | B2 | 11/2006 | Uratani et al. | |
| 7,203,991 | B2 | 4/2007 | Stephens et al. | |
| 7,322,071 | B2 | 1/2008 | Lee et al. | |
| 7,412,748 | B2 | 8/2008 | Lee et al. | |
| 7,587,786 | B2 | 9/2009 | Zahuranec et al. | |
| 7,690,078 | B2 | 4/2010 | Zahuranec et al. | |
| 9,107,558 | B2 | 8/2015 | Lenkiewicz et al. | |
| 9,282,869 | B2 | 3/2016 | Wall et al. | |
| 9,538,893 | B2 | 1/2017 | Wall et al. | |
| 9,549,648 | B2 | 1/2017 | Lenkiewicz, Jr. et al. | |
| 9,706,893 | B2 | 7/2017 | Wall et al. | |
| 9,717,386 | B2 | 8/2017 | Wall et al. | |
| 9,788,699 | B2 | 10/2017 | Wall et al. | |
| 9,788,700 | B2 | 10/2017 | Wall et al. | |
| 10,342,402 | B2 | 7/2019 | Lenkiewicz et al. | |
| 2005/0015916 | A1 | 1/2005 | Orubor | |
| 2005/0076467 | A1 * | 4/2005 | Stephens | A47L 11/34 15/329 |
| 2007/0094840 | A1 | 5/2007 | Zahuranec et al. | |
| 2007/0136979 | A1 * | 6/2007 | Zahuranec | A47L 5/32 15/328 |
| 2012/0110775 | A1 * | 5/2012 | Krebs | A47L 9/0472 15/347 |
| 2015/0245758 | A1 | 9/2015 | Wall et al. | |
| 2019/0167053 | A1 | 6/2019 | Alsweis | |
| 2019/0313865 | A1 | 10/2019 | Lenkiewicz et al. | |

* cited by examiner

SURFACE CLEANER

CROSS-REFERENCE TO RELATED APPLICATIONS

This application claims priority to U.S. Provisional Patent Application No. 63/212,405, filed Jun. 18, 2021, the entire contents of which are hereby incorporated by reference herein.

BACKGROUND

The present invention relates to surface cleaners, including vacuum cleaners, extractors, and the like.

SUMMARY

The invention provides a surface cleaner including a suction source configured to generate a suction airflow along an airpath between a suction inlet and an air exhaust, a collection container along the airpath in communication with the suction inlet and the suction source, a base movable along a surface to be cleaned, and the base including a nozzle forming the suction inlet. The surface cleaner further includes an accessory body removably coupled to the base, an accessory agitator disposed on the accessory body, a conduit between the nozzle and the collection container along the airflow path, and an upright portion pivotally coupled to the base. The nozzle has a first nozzle portion having a first nozzle passageway attached to the base and a second nozzle portion having a second nozzle passageway attached to the accessory body and removable with the accessory body. The first nozzle portion and second nozzle portion are releasably coupled connecting the first and second nozzle passageways along the airpath in fluid communication with the collection container when the accessory body is coupled to the base. The first nozzle passageway forms the suction inlet when the accessory body is coupled to the base and the second nozzle passageway forms the suction inlet in communication with the collection container and the suction source when the accessory body is uncoupled from the base.

A surface cleaner including a suction source configured to generate a suction airflow along an airpath between a suction inlet and an air exhaust, a collection container along the airpath in communication with the suction inlet and the suction source, a base movable along a surface to be cleaned, the base including a nozzle forming the suction inlet. The surface cleaner further includes a conduit between the nozzle and the collection container along the airflow path, an upright portion pivotally coupled to the base, and a supply tank configured to contain a cleaning solution. A fluid distribution system has a fluid port disposed on the base in fluid communication with the supply tank configured to selectively deliver fluid from the supply tank and an actuator is configured to initiate fluid delivery through the fluid port. The base includes a first accessory body removably coupled to the base, the first accessory body including a first fluid distributor releasably coupled to the fluid port configured to deliver fluid to the surface to be cleaned when the first accessory body is coupled to the base. The nozzle has a first nozzle portion having a first nozzle passageway attached to the base and a second nozzle portion having a second nozzle passageway attached to the first accessory body and removable with the first accessory body. The first nozzle portion and second nozzle portion are releasably coupled connecting the first and second nozzle passageways along the airpath in fluid communication with the collection container when the first accessory body is coupled to the base. The base includes a second accessory body, the second accessory body having a third nozzle portion having a third nozzle passageway and a second fluid distributor. The second accessory body is releasably couplable to the base to couple the second fluid distributor to the fluid port when the first accessory body is uncoupled, connecting the first and third nozzle passageways along the airpath in fluid communication with the collection container when the second accessory body is coupled to the base.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
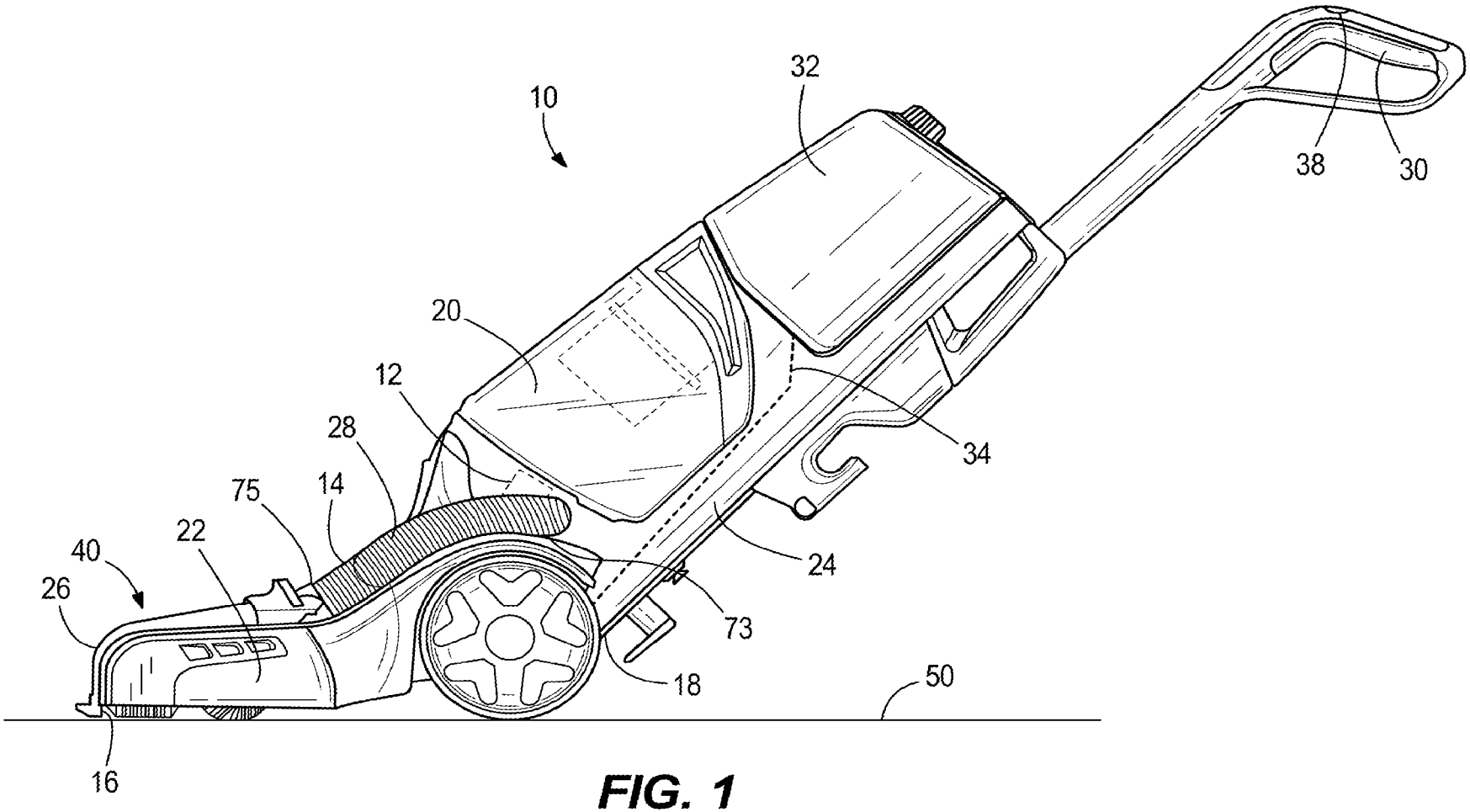
FIG. 1 is a side view of a surface cleaner according to one embodiment.

FIG. 1 illustrates a surface cleaner 10. The surface cleaner 10 includes a suction source 12 that generates a suction airflow along an airpath 14 between a suction inlet 16 and an air exhaust 18. A collection container 20 is located along the airpath 14 in communication with the suction inlet 16 and the suction source 12. In the illustrated embodiment, the surface cleaner 10 is an extractor and the collection container 20 is a recovery tank. In other embodiments, including if the surface cleaner 10 is a vacuum cleaner, the collection container may include other types of surface cleaner collection containers, including a cyclonic separator, a filter bag, and/or the like.

The surface cleaner 10 further includes a base 22 and an upright portion 24 pivotally coupled to the base 22. The base 22 includes a nozzle 26 forming the suction inlet 16. A conduit 28 is between the nozzle 26 and the collection container 20 along the airpath 14 and the conduit 28 provides fluid communication between the suction inlet 16 and the suction source 12. The base 22 is movable along a surface 50 to be cleaned using the upright portion 24 that includes a handle 30. The illustrated surface cleaner 10 includes a supply tank 32 that contains a cleaning solution, such as water, detergent, or a mixture of water and detergent. A fluid distribution system 34 provides fluid communication from the supply tank 32 to a fluid distributor 44 (FIG. 2) on the base 22. An actuator 38 is located adjacent the handle 30 and the actuator 38 is operable by the user to initiate fluid delivery from the supply tank 32 through the fluid distributor 44.

Figure 2:
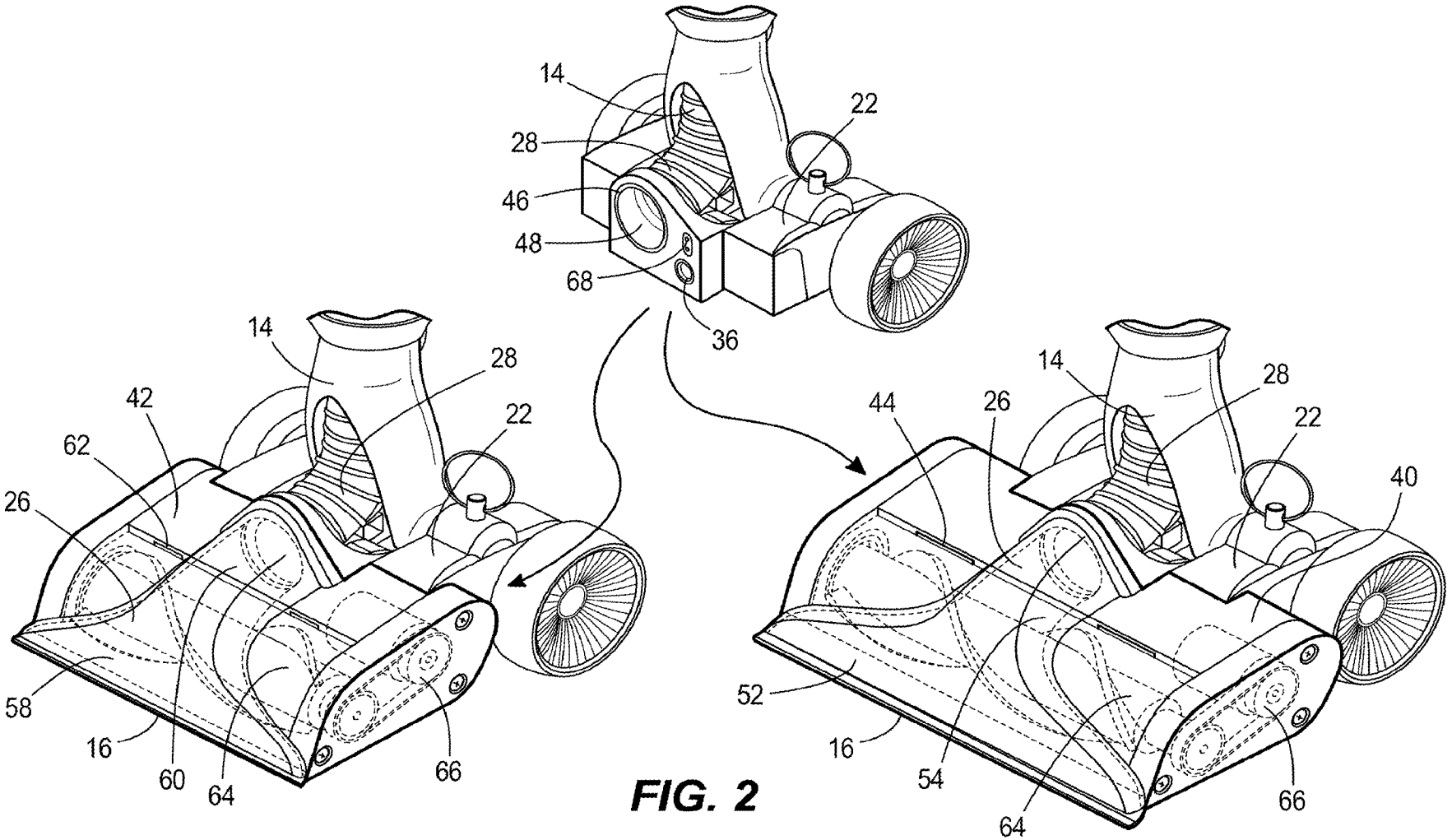
FIG. 2 is a perspective view of a base of the surface cleaner of FIG. 1 showing first and second accessory bodies attached to the base.

Referring to FIG. 2, in one embodiment the surface cleaner 10 includes a first accessory body 40 and a second accessory body 42 that are interchangeably and removably coupled to the base 22. The fluid distribution system 34 provides fluid communication from the supply tank 32 to a fluid port 36 on the base 22. The first accessory body 40 includes a first fluid distributor 44, such as a spray nozzle, orifice, spray bar, and the like. When the first accessory body 44 is attached to the base 22, the first fluid distributor 44 is in fluid communication with the fluid port 36 to deliver fluid to the surface 50 to be cleaned. The first fluid distributor 44 is removable from the base 22 with the first accessory body 40. The nozzle 26 includes a first nozzle portion 46 having a first nozzle passageway 48 attached to the base 22. The nozzle 26 further includes a second nozzle portion 52 having a second nozzle passageway 54 attached to the first accessory body 40 such that the second nozzle portion 52 is removable from the base 22 with the first accessory body 40. The first nozzle portion 46 and the second nozzle portion 52 are releasably coupled to connect the first and second nozzle passageways 48, 54 along the airpath in fluid communication with the collection container 20 and the suction source 12 when the first accessory body 40 is coupled to the base 22.

The second accessory body 42 has a third nozzle portion 58 having a third nozzle passageway 60. The second accessory body 42 also includes a second fluid distributor 62. When the second accessory body 42 is coupled to the base 22, the first and third nozzle passageways 48, 60 are connected along the airpath 14 to provide fluid communication between the suction inlet 16, the collection container 20, and the suction source 12. Also, the second fluid distributor 62 is coupled to the fluid port 36 and in fluid communication with the fluid port 36. The second accessory body 42 is releasably couplable to the base 22 to uncouple the second fluid distributor 62 from the fluid port 36.

With continued reference to FIG. 2, the first and second accessory bodies 40, 42 both include an agitator 64 operatively positioned in the accessory body 40, 42. The agitator 64 may include a brushroll, wipers, mop, pad, or the like. The accessory bodies 40, 42 also include an agitator drive 66 that operates or rotates the agitator 64. In the illustrated embodiment, the drive 66 includes a motor and a transmission (e.g., belt or gear drive). In the illustrated embodiment, an electrical connection 68 is located on the base 22 to provide electrical power to the drive 66 when the first accessory body 40 or the second accessory body 42 is coupled to the base 22 engaging the electrical connection 68. In one embodiment, in one or both of the first and second accessory bodies 40, 42, the drive 66 includes an air turbine to drive the agitator 64 instead of an electric motor. In another embodiment, one or both of the first and second accessory bodies 40, 42 does not include a driven or powered agitator.

In operation, the user moves the base 22 of the surface cleaner 10 across the surface 50 using the handle 30. With the first accessory body 40 connected to the base 22, the user presses the actuator 38 to dispense the cleaning solution from the supply tank 32 and through the fluid distributor 44 and onto the surface 50. The agitator 64 scrubs or otherwise agitates the surface 50 with the cleaning solution. The cleaning solution and debris is drawn through the suction inlet 16 by a suction airflow generated by the suction source 12. The cleaning solution, the debris, and the airflow travel through the nozzle 26, the conduit 28, and into the collection container 20. In the collection container 20, the debris and cleaning solution are separated from the airflow and retained in the collection container 20 and the airflow is exhausted through the air exhaust 18. The user may remove the first accessory body 40 from the base 22 and replace the first accessory body 40 with the second accessory body 42. For example, in one embodiment, the second accessory body 42 is smaller than the first accessory body 40. In one embodiment, the nozzle 26 on the second accessory body 42 has a dimension along the front of the nozzle that is shorter than a dimension along the front of the nozzle of the first accessory body 40 providing a narrower base in a cleaning direction. The smaller second accessory body 42 can then be used to clean smaller areas, including stairs, upholstery, or spot cleaning. The base 22 of FIG. 2 can be used with the surface cleaner 10 illustrated in FIGS. 1 and 12 and described herein or other cleaners.

Figure 3:
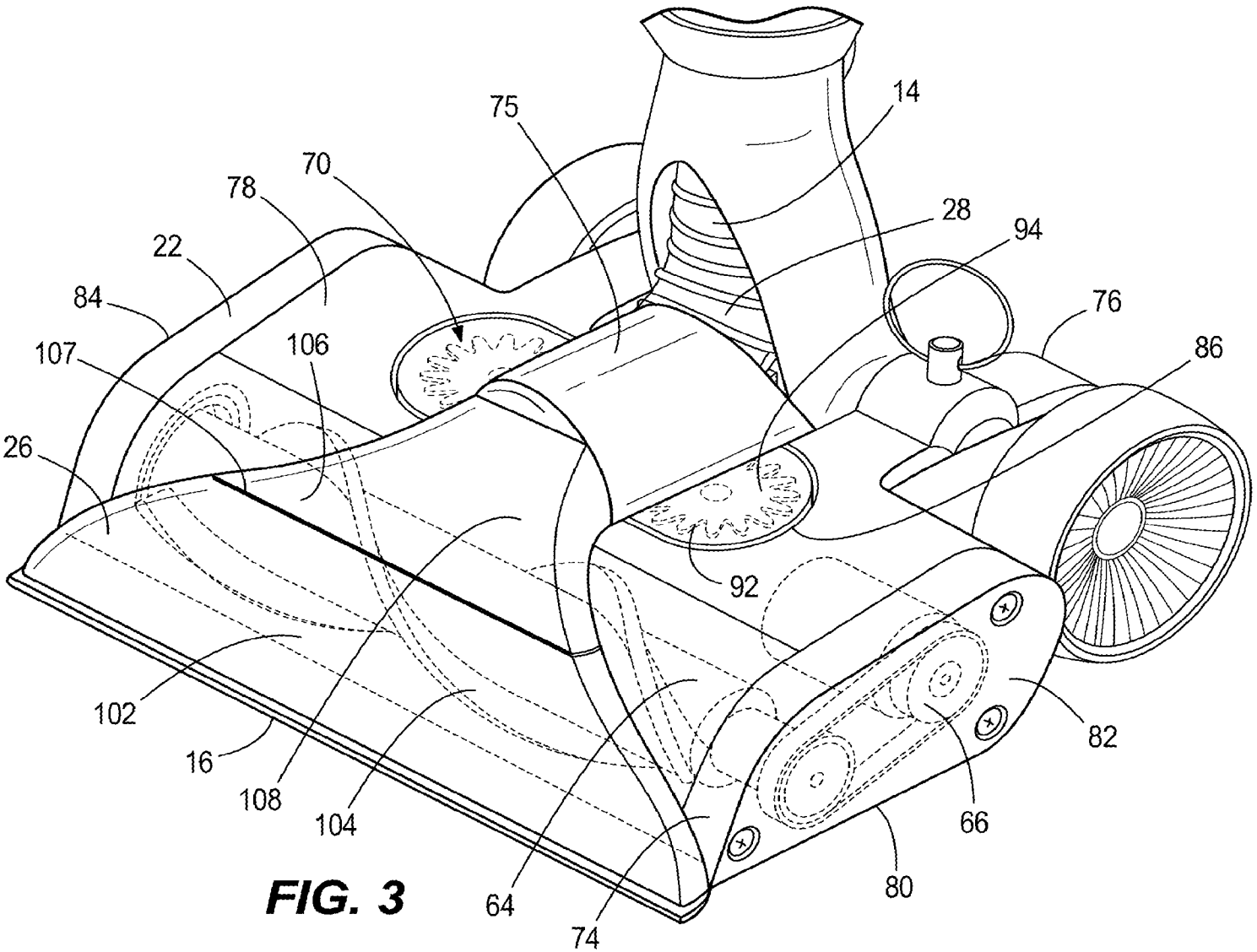
FIG. 3 is a perspective view of a base of a surface cleaner according to another embodiment.
Figure 4:
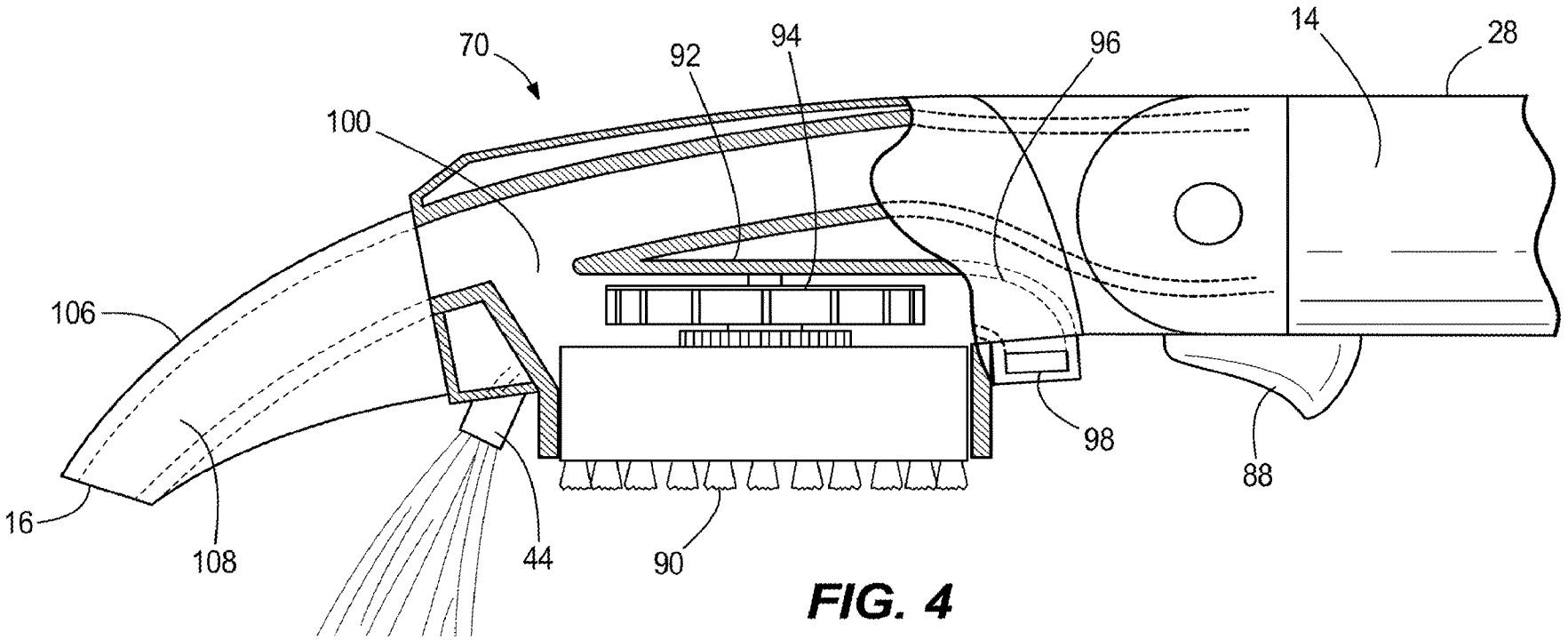
FIG. 4 is a side view of an accessory body of surface cleaner of FIG. 3.
Figure 5:
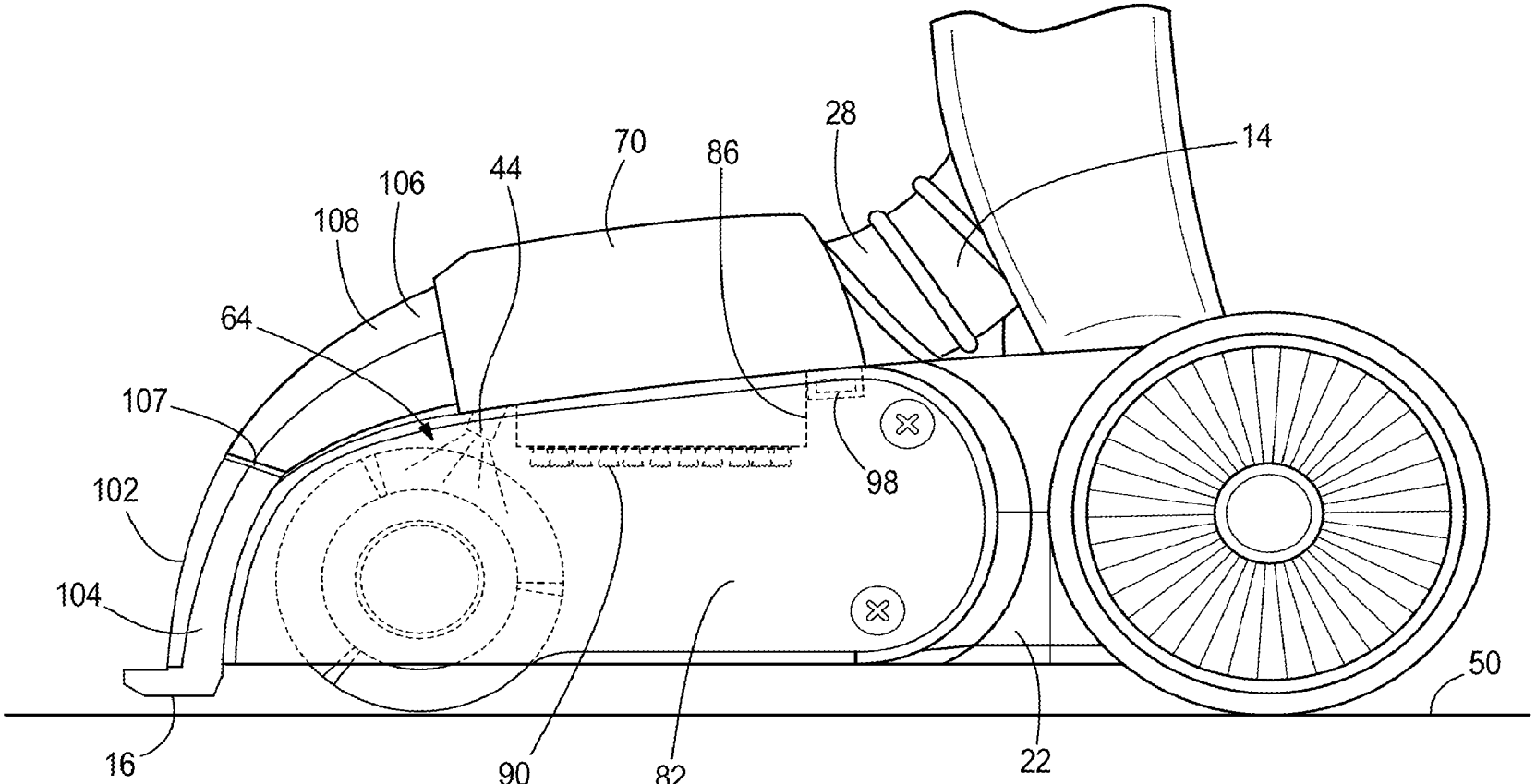
FIG. 5 is a cross-sectional view of the base and the accessory body of FIG. 3.

FIGS. 3-5 illustrates a base 22 for a surface cleaner according to another embodiment. The base 22 of FIGS. 3-5 can be used with the surface cleaner 10 illustrated in FIGS. 1 and 12 and described herein and other cleaners. Only some of the differences between the base 22 of FIGS. 3-5 and the base 22 of FIGS. 1-2 will be described and like components have been given the same reference number.

Referring to FIGS. 3-5, the base 22 includes an accessory body 70 that is removably coupled to the base 22. As discussed with respect to the second accessory body 40, the accessory body 70 is smaller than the size of the base 20 providing a portable cleaning tool. The accessory body 70 is used by the user to clean generally small areas, including spot cleaning, upholstery, stairs, and the like. The conduit 28 includes a proximal end 73 (FIG. 1) connected to the upright portion 24 in fluid communication with the collection container 20 and a distal end 75 connected to the base 22 and the accessory body 70. The base 22 includes a forward side 74, a rearward side 76, an upper side 78, and a lower side 80, a first lateral side 82 and a second lateral side 84. A recess 86 is located on the upper side 78 of the base 22 in the illustrated embodiment. In other embodiments, the recess 86 is in the forward side 74 or a combination of the forward side 74 and the upper side 78. The accessory body 70 is removably coupled to the base 22 and the accessory body 70 is disposed in the recess 86 when the accessory body 70 is coupled to the base 22 as shown in FIG. 3.

The accessory body 70 includes an actuator 88 (FIG. 4). The actuator 88 initiates fluid delivery through the fluid distributor 44. The actuator 88 is used to dispense cleaning solution from the supply tank 12 when the accessory body 70 is uncoupled from the base 22 and when the actuator 88 is actuated by the user. In the illustrated embodiment, as shown in FIG. 5, the fluid distributor 44 is the same fluid distributor 44 that is used to dispense cleaning solution when the accessory body 70 is coupled to the base 22. When the accessory body 70 is coupled to the base 22, the flow of cleaning solution through the fluid distributor 14 is controlled by the actuator 38 (FIG. 1) located on the handle 30.

The accessory body 70 further include an accessory agitator 90 disposed on the accessory body 70. The accessory agitator 90 is removable with the accessory body 70 from the base 22. The accessory agitator 90 is operable to agitate or scrub the surface 50 when the accessory body 70 is uncoupled from the base 22 as shown in FIG. 4. The accessory body 70 includes an accessory agitator drive 92. In the illustrated embodiment, the drive 92 includes an air turbine 94 driven along a turbine airpath 96 having a turbine air inlet 98 and a turbine air outlet 100. The turbine air outlet 100 is fluidly connected to the airpath 14 and suction source 12. The turbine air inlet 98 is open when the accessory body 70 is uncoupled from the base 22 and the turbine air inlet 98 is closed or covered when the accessory body 70 is coupled to the base 22. In one embodiment, the turbine air inlet 98 is positioned such that a portion of the base 22 covers the turbine air inlet 98 when the accessory body 70 is coupled to the base 22, such as a portion of the upper side 78, a wall of the recess 86, or other portion of the base configured to close the turbine air inlet 98. Closing or covering the turbine air inlet 98 prevents the airflow from driving the air turbine 94 and rotating the accessory agitator 90. In the illustrated embodiment, the accessory agitator 90 rotates about a generally upright axis transverse to the surface to be cleaned. In one embodiment, the accessory agitator drive 92 includes an electric motor and a transmission (e.g., belt or gear drive) that operates or rotates the agitator 90 instead of the air turbine 94. In another embodiment, the accessory body 70 does not include a driven or powered agitator.

With continued reference to FIGS. 3-5, the nozzle 26 includes a first nozzle portion 102 that has a first nozzle passageway 104. The first nozzle portion 102 includes the suction inlet 16. The first nozzle portion 102 is attached to the base 22 and remains attached to the base 22 when the accessory body 70 is uncoupled from the base 22. The nozzle 26 includes a second nozzle portion 106 that has a second nozzle passageway 108. The second nozzle portion 106 is attached to the accessory body 70 so that the second nozzle portion 106 is removable with the accessory body 70 from the base 22. The second nozzle portion 106 forms the suction inlet 16 when the accessory body 70 is removed from the base 22. When the accessory body 70 is coupled to the base 22, the first and second nozzle portions 102, 106 are coupled to connect the first and second passageways 104, 108 along the airpath in fluid communication with the collection container 20 and the suction source 12 and the first nozzle passageway 104 forms the suction inlet 16. A gasket 107, such as rubber gasket or the like, is located between the first and second nozzle portions 102, 106. The gasket 107 creates a seal between the nozzle portions 102, 106 to inhibit air from flowing between the interface between the nozzle portions 102, 106 and into the passageways 104, 108 during operation of the surface cleaner. The gasket 107 remains attached to the first nozzle portion 102 when the second nozzle portion 106 is removed. When the accessory body 70 is uncoupled from the base, the second nozzle passageway 108 forms the suction inlet 16 in communication with the collection container 20 and the suction source 12 (without the first nozzle passageway 104).

Figure 6:
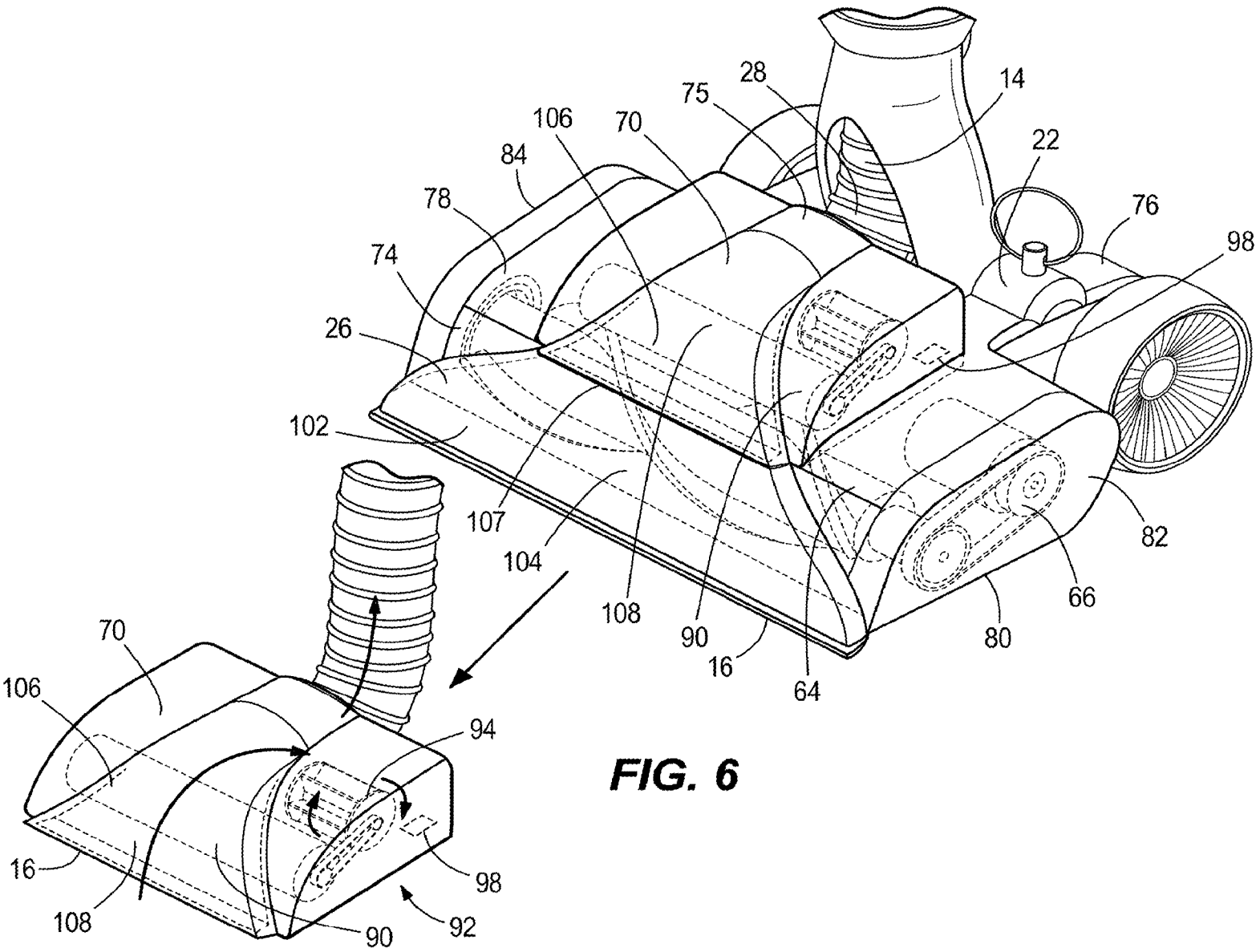
FIG. 6 is a perspective view of a base and a surface cleaner according to another embodiment.
Figure 6A:
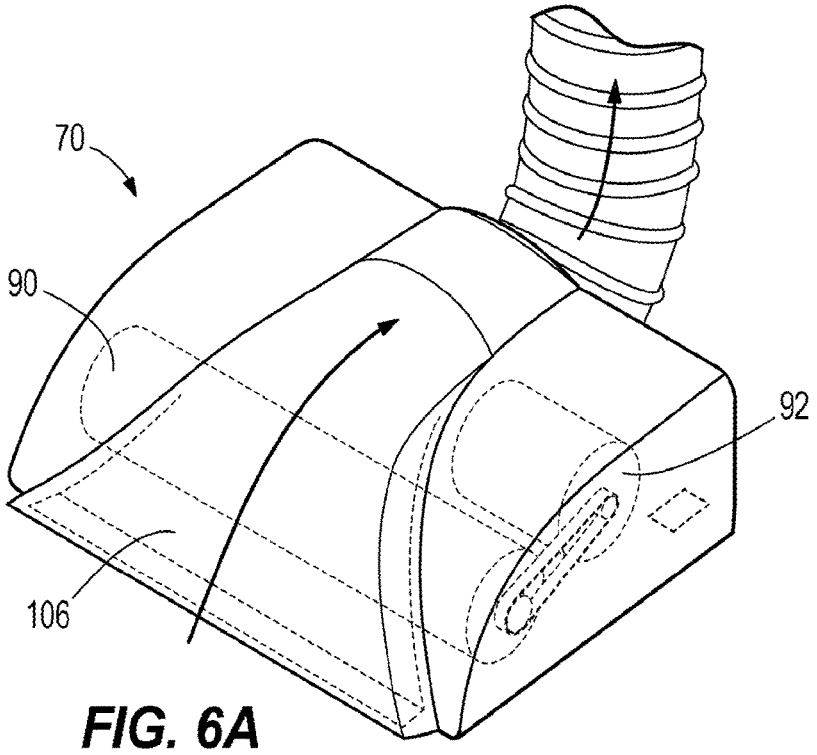
FIG. 6A is perspective view of a base of a surface cleaner according to another embodiment.
Figure 7:
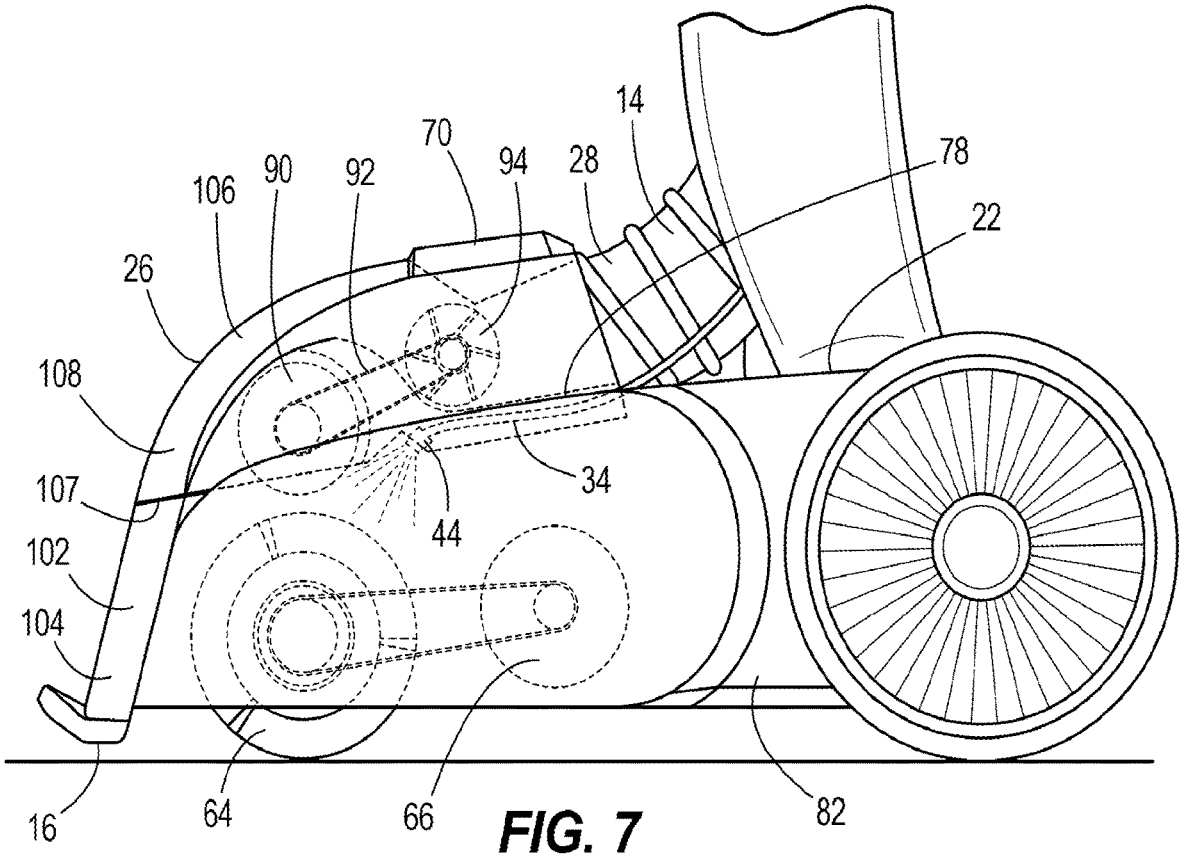
FIG. 7 is a cross-sectional view of the base and the surface cleaner of FIG. 6.

FIGS. 6-7 illustrates a base for a surface cleaner according to another embodiment. The base 22 of FIGS. 6-7 can be used with the surface cleaner 10 illustrated in FIGS. 1 and 12 and described herein and other cleaners and in place of the base 22 of FIGS. 3-5. Like components have been given the same reference number. The base 22 of FIGS. 6-7 is similar to the base 22 of FIGS. 3-5. However, the accessory agitator drive 92 of FIGS. 6-7 includes an air turbine 94 that rotates about a horizontal axis to drive the accessory agitator 90. Also, the accessory agitator 90 rotates about a horizontal axis generally parallel to the surface to be cleaned. In the embodiment shown in FIG. 6A, the accessory agitator drive 92 includes an electric motor and a transmission (e.g., belt or gear drive) that operates or rotates the agitator 90 instead of the air turbine 94. In another embodiment, the accessory body 70 does not include a driven or powered agitator.

Figure 8:
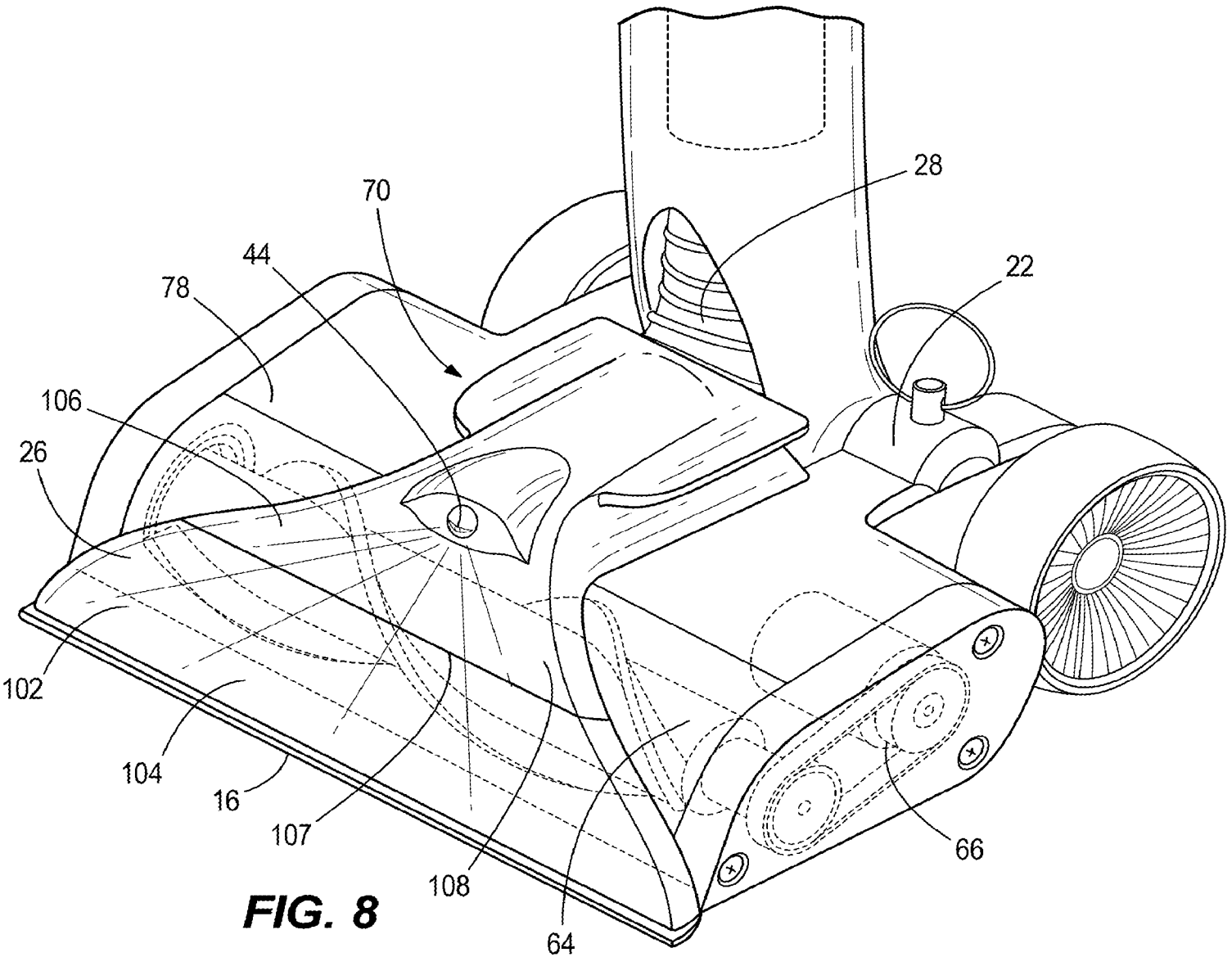
FIG. 8 is a perspective view of a base and a surface cleaner according to another embodiment.
Figure 9:
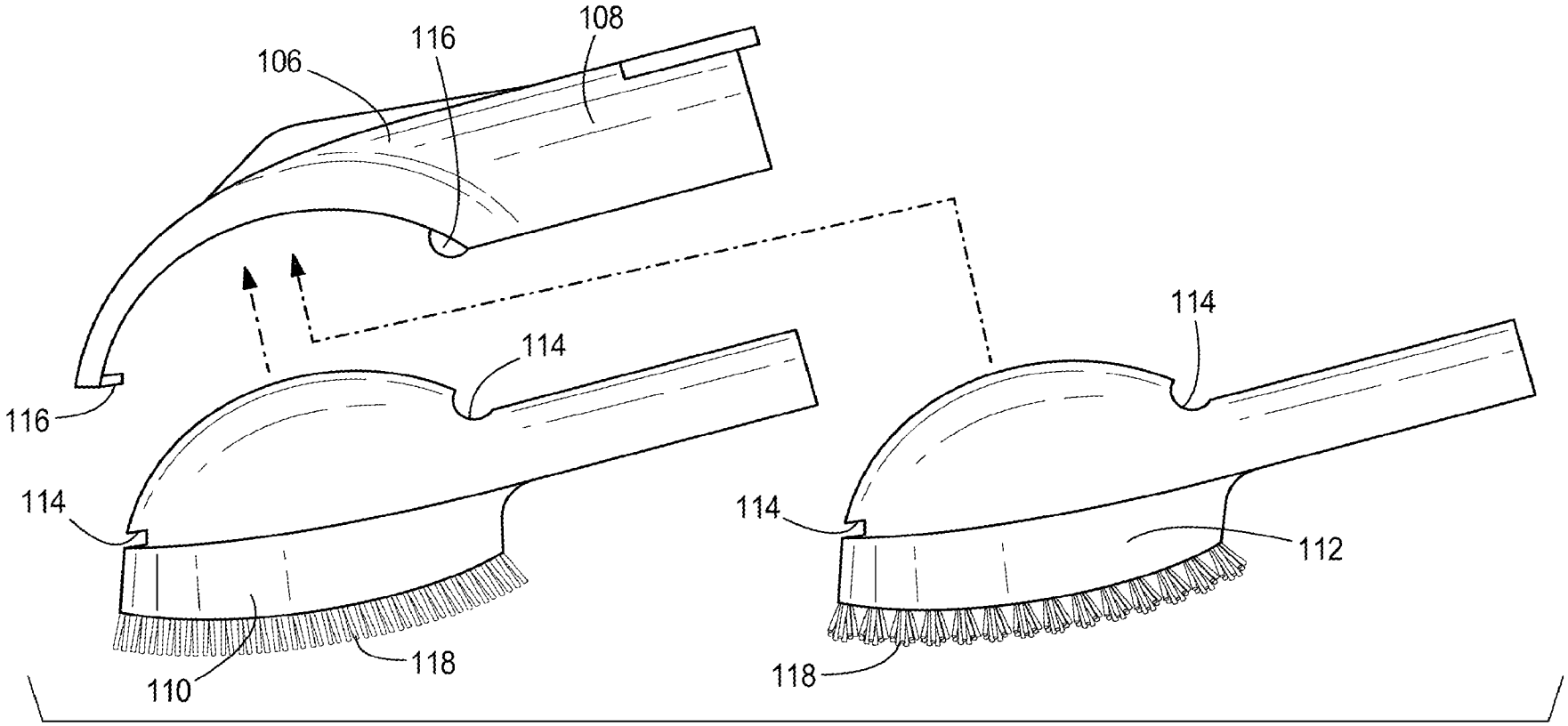
FIG. 9 is a side view of an accessory body of the surface cleaner of FIG. 8.

FIGS. 8-9 illustrates a base for a surface cleaner according to another embodiment. The base 22 of FIGS. 8-9 can be used with the surface cleaner 10 illustrated in FIGS. 1 and 12 and described herein and other cleaners and in place of the bases 22 of FIGS. 3-5 and 6-7. Like components have been given the same reference number. The base 22 of FIGS. 8-9 is similar to the bases 22 described above. However, the base 22 of FIGS. 8-9 includes manual agitators 110, 112 that are not driven by a drive system such as a motor or turbine. Rather, the agitators 110, 112 are manually moved relative to the surface to scrub or agitate the surface. The illustrated agitators 110, 112 are removably coupled to the nozzle portion 106 of the accessory body 70. In the illustrated embodiment, the agitators 110, 112 include recesses 114 that receive projections 116 of the nozzle portion 106 to removable couple the agitators 110, 112 to the nozzle portion 106. The agitators 110, 112 include different surface agitating members 118, such as different types of bristles or brushes.

FIGS. 13-16 illustrates a base for a surface cleaner according to another embodiment. The base 22 of FIGS. 13-16 can be used with the surface cleaner 10 illustrated in FIGS. 1 and 12 and described herein and other cleaners and in place of the bases 22 of FIGS. 3-5 and 6-7 and 8-9. Like components have been given the same reference number. The base 22 of FIGS. 13-16 is similar to the bases 22 described above. However, when the accessory body 70 is coupled to the base 22 the agitator 64 of FIGS. 13-16 is coaxial with the accessory agitator 90 and the accessory agitator drive 92 rotates both the agitator 64 and the accessory agitator 90. The agitator 64 and coaxial accessory agitator 90 are configured to couple together to form a unitary agitator across the width of the base 22 when the accessory body 70 is coupled to the base 22. When the accessory body 70 is uncoupled from the base, the agitator 64 remains in the base.

In the embodiments of FIGS. 13-16, the agitators 64, 90 are operatively connected to bearings 140 mounted in bearing seats 142 on each end of the agitators 64, 90 and rotatable about an agitator axis 144. When the accessory body 70 is coupled to the base 22, the agitator 64 is joined with the accessory agitator 90 by a coupling 146. The coupling 146 includes a first coupler 148 disposed on an inward end 150 of the agitator 64. A second coupler 152 is disposed on an outward end 154 of the accessory agitator 90. The first coupler 148 is operatively positioned in a base coupling aperture 156 along the agitator axis 144. The second coupler 152 is operatively positioned in an accessory coupling aperture 158 along the agitator axis 144 aligned with and engaging the first coupler 148 when the accessory body 70 is coupled to the base 22.

The first coupler 148 includes one or more first engagement members 160, and the second coupler 152 includes one or more second engagement members 162. The first and second engagement members 160, 162 are configured to releasably connect the first coupler 148 to the second coupler 152 when the accessory body 70 is coupled to the base 22. In the illustrated embodiment, the first engagement members 160 include protruding members and the second engagement members 162 include corresponding recesses to receive each protruding member. In one embodiment, the first and second engagement members 160, 162 include intermeshing gears or other interconnecting driving surfaces. In one embodiment, one or both of the first and second couplers 148, 152 include a friction material on the connecting surface to inhibit slippage between the first coupler 148 and the second coupler 152 when the accessory agitator drive 92 rotates the accessory agitator 90 and in turn the second coupler 152.

In one embodiment, a spring 164 presses the first coupler 148 toward the second coupler 152 or presses the second coupler 152 toward the first coupler 148 when the accessory body 70 is coupled to the base 22. In the illustrated embodiment, the spring 164 is connected to the agitator 64 pressing the first coupler 148 toward the second coupler 152. In one embodiment, the spring 164 is a wave washer. In another embodiment, the spring 164 is a coil spring. In one embodiment, each agitator 64, 90 includes a spring 164 pressing first coupler 148 and the second coupler 152 together.

Figure 13:
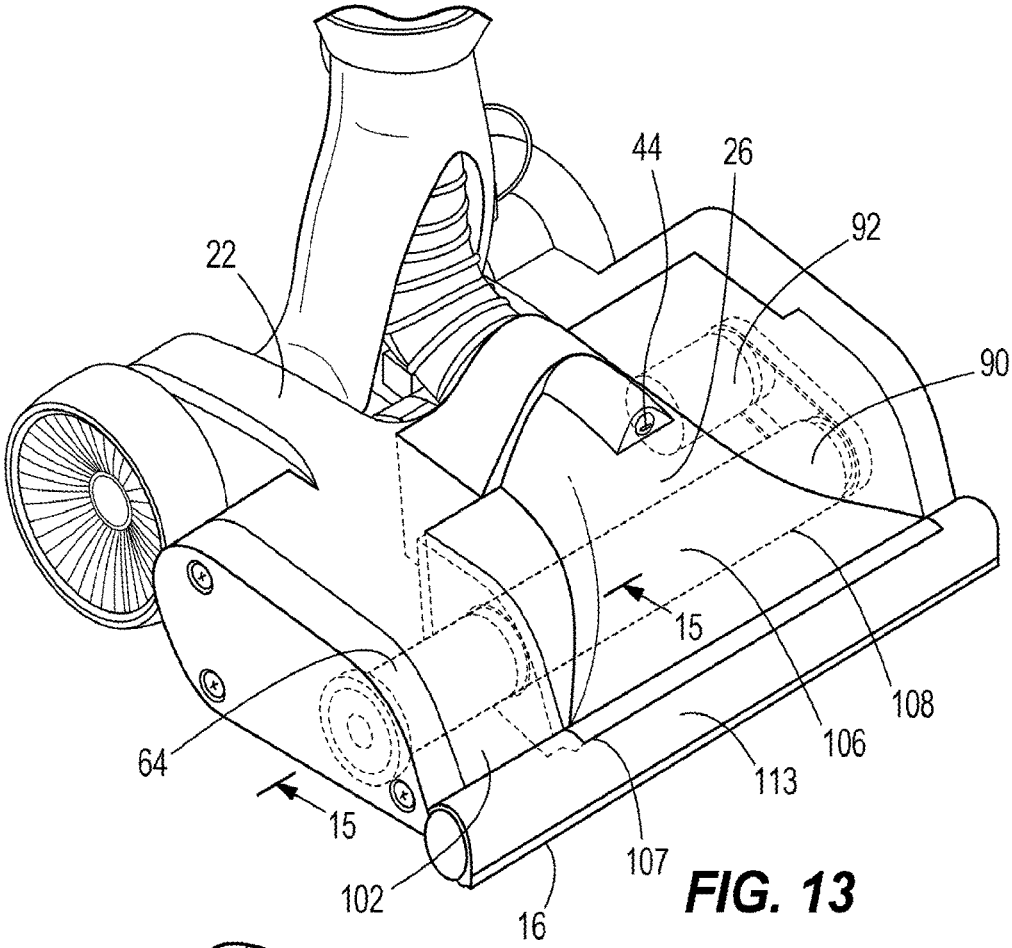
FIG. 13 is a perspective view of a base of a surface cleaner according to another embodiment.

In the embodiment of FIG. 13, the first nozzle portion 102 includes a centrifugal nozzle 113 that includes the suction inlet 16. The suction inlet 16 is arranged to deliver the debris and air upwardly through a tangential inlet of the centrifugal nozzle 113, into a cylindrical body of the nozzle 113 and along an inside wall of the cylindrical body. This creates a swirling or centrifugal flow within the cylindrical body of the nozzle 113 about the longitudinal axis of the nozzle 113 to provide a more even distribution of suction along the suction inlet 16.

Figure 14:
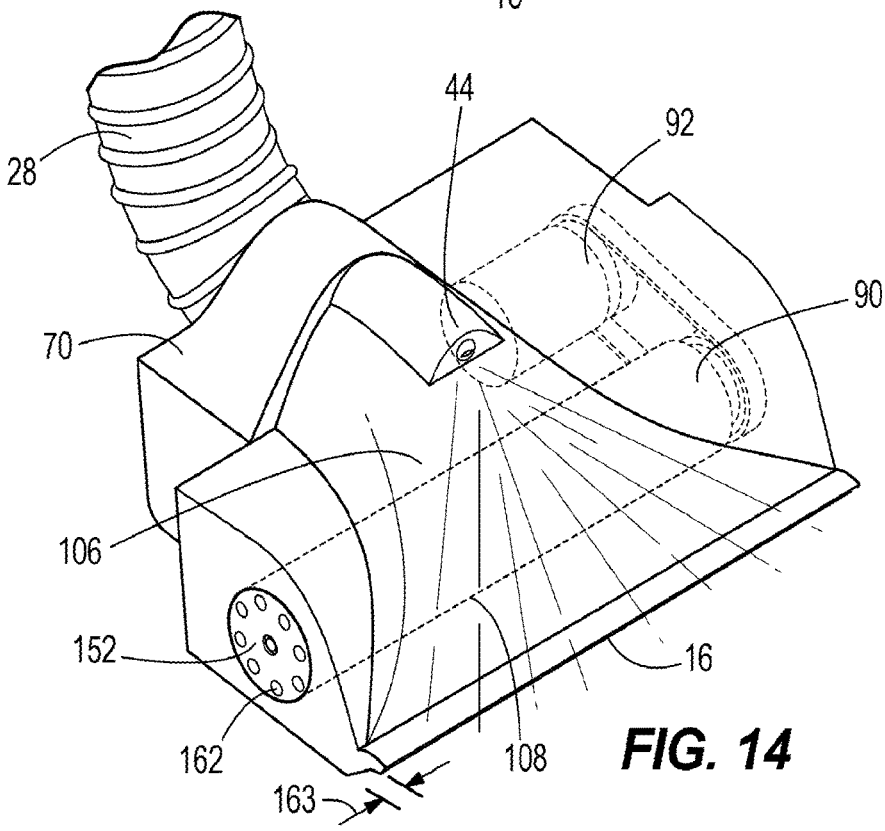
FIG. 14 is a perspective view of an accessory body of the base of FIG. 13.
Figure 15:
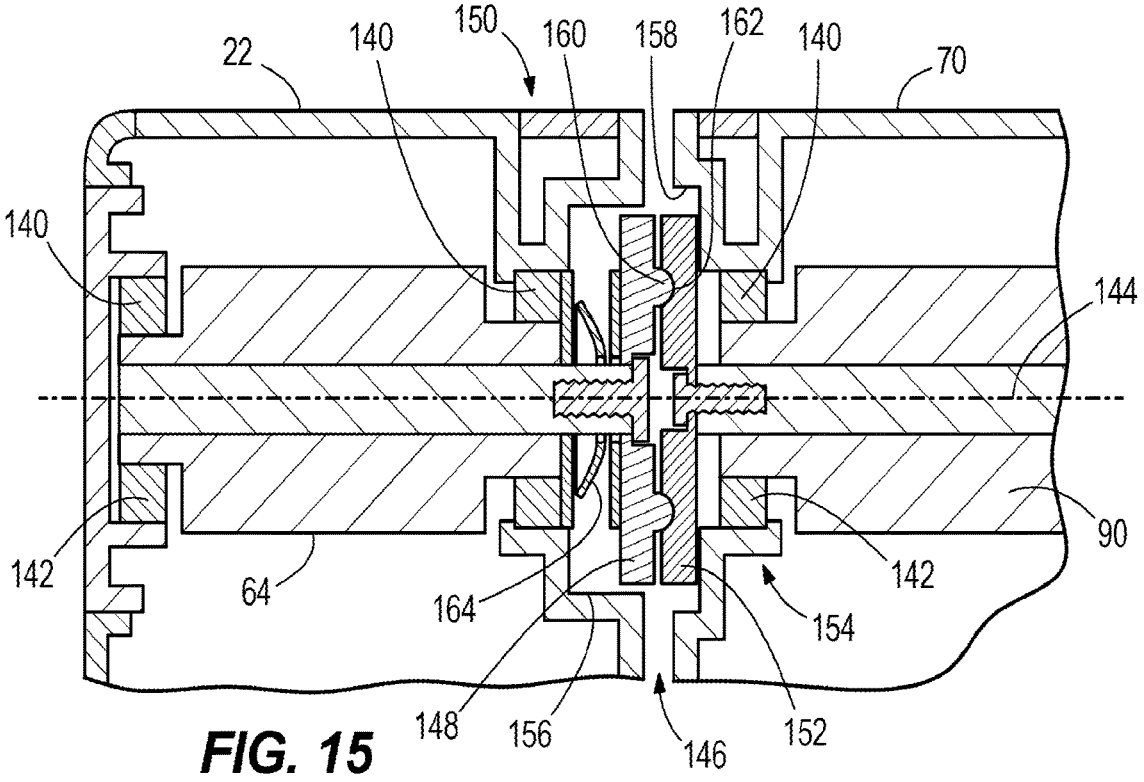
FIG. 15 is a cross-sectional view of a portion of the base of FIG. 13.
Figure 16:
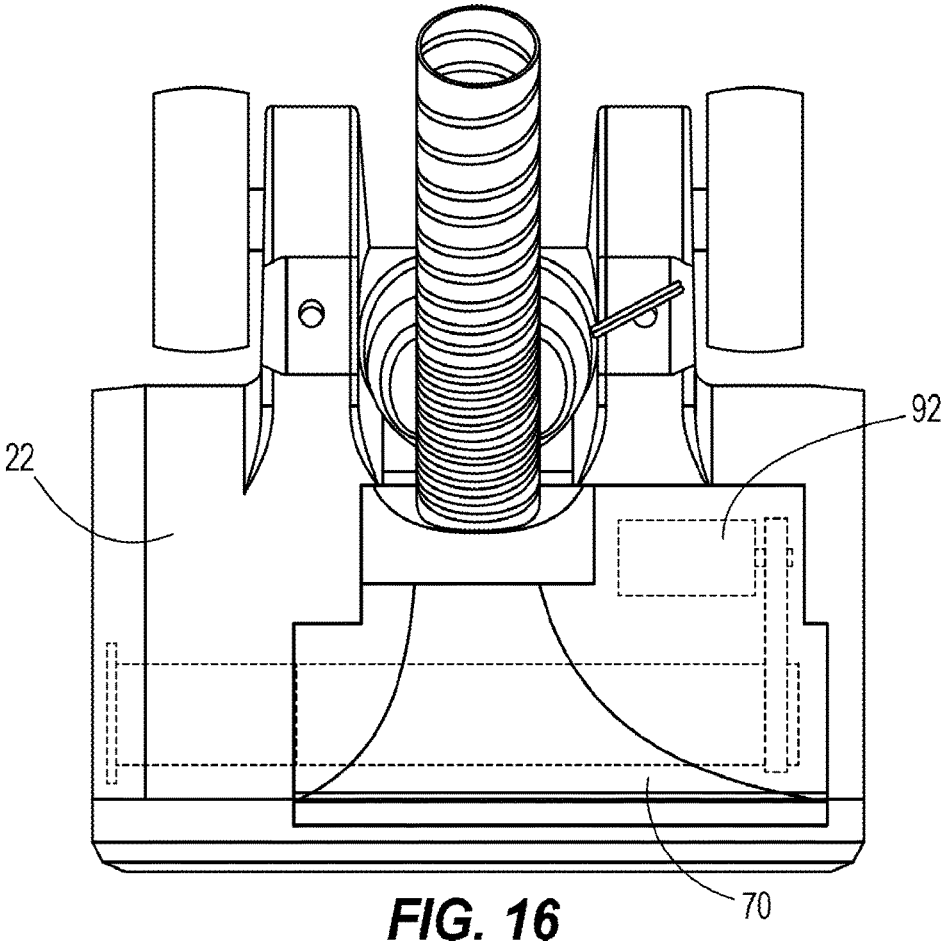
FIG. 16 is a top view of the base of FIG. 13.

With continued reference to the embodiment of FIGS. 13 and 14, as discussed above, when the accessory body 70 is coupled to the base 22, the agitator 64 and coaxial accessory agitator 90 are coupled together to form a unitary agitator across the width of the base 22 that contacts the surface to be cleaned. Also, the suction inlet 16 of the accessory body 70 sits on top of the cylindrical body of the centrifugal nozzle 113 when the accessory body 70 is coupled to the base 22. Accordingly, the suction inlet 16 of the accessory body is raised or offset a distance 163 from the bottom of the accessory body 70 so that the suction inlet 16 of the accessory body sits on top of the centrifugal nozzle 113 and yet the accessory agitator 90 can contact the surface to be cleaned when the accessory body 70 is coupled to the base 22. When the accessory body 70 is uncoupled from the base 70, the user tilts the accessory body 70 forward slightly to bring the suction inlet 16 of the accessory body 70 in contact with the surface being cleaned.

In the embodiments of FIGS. 3-9 and 13-16, when the accessory body 70 is uncoupled from the base 22, the conduit 28 provides fluid communication between the nozzle 106 and the collection container 20. The proximal end 75 of the conduit is connected to the base 22 or upright portion 24 such that the distal end 73 and the uncoupled accessory body 70 are operable a distance from the base 22 for spot cleaning or other small area cleaning, such as between 0.3 meters and 1 meter distance, or between 0.5 meter and 2 meters, or greater distance. In one embodiment, the conduit 28 is a stretch hose such that a user can extend the length of the conduit 28 to operate the accessory body 70 a distance from the base. In another embodiment, the conduit 28 is a generally fixed length and supported on the cleaner in a stowed position. In one embodiment, such as in FIG. 1, the conduit 28 is a stretch hose extending along the base 22 and or upright portion 24 in the stowed position.

Figure 10:
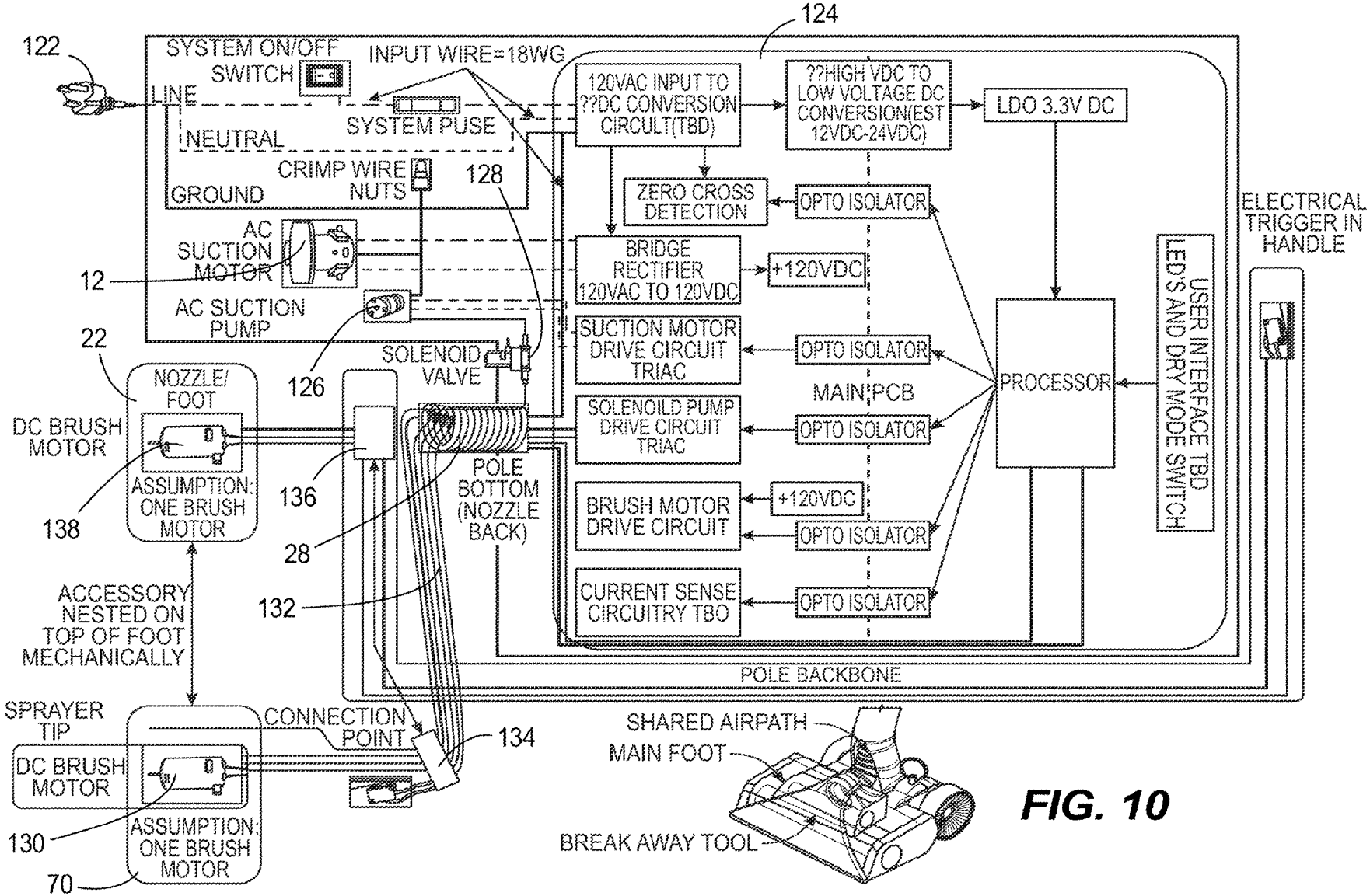
FIG. 10 is a diagram of the floor cleaner according to another embodiment.
Figure 11:
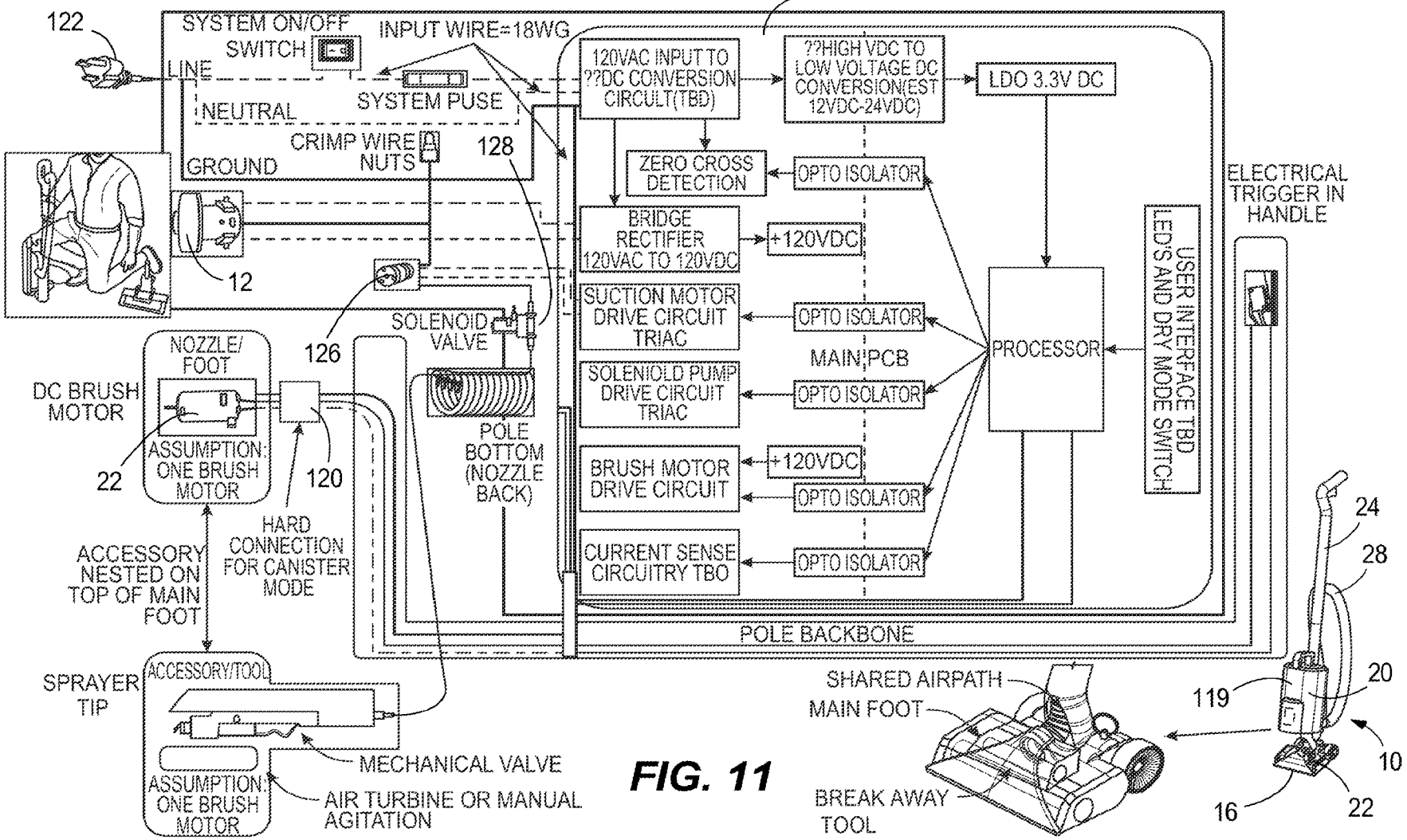
FIG. 11 is a diagram of the floor cleaner according to another embodiment.
Figure 12:
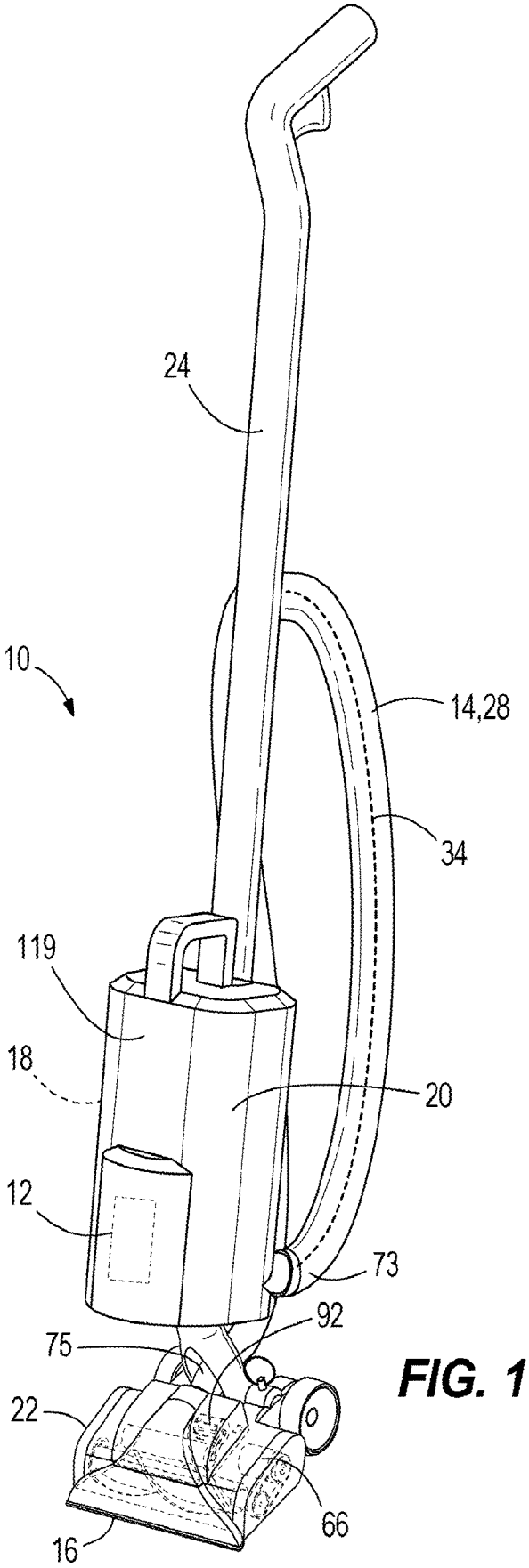
FIG. 12 is a perspective view of a surface cleaner according to another embodiment.
Figure 18:
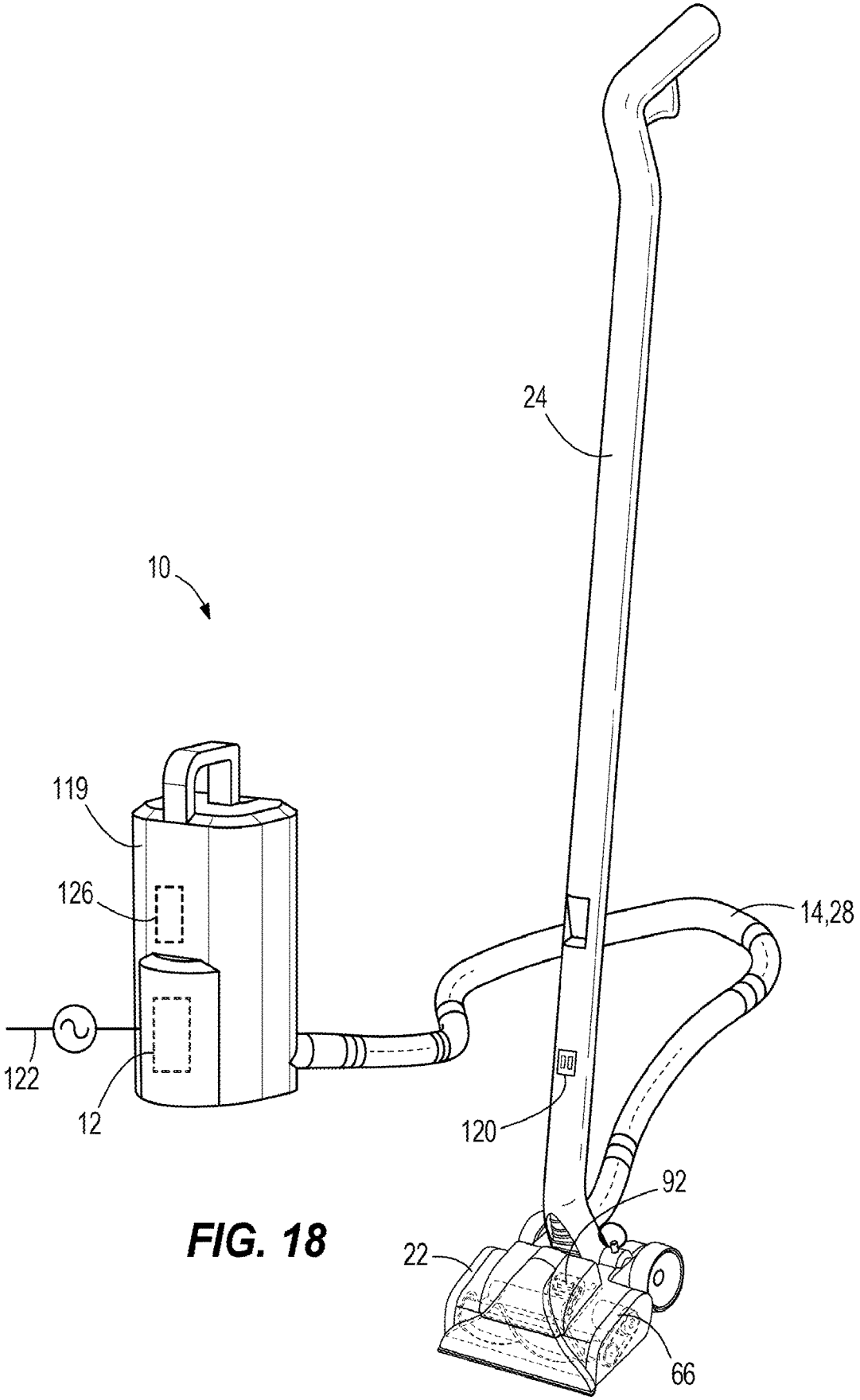
FIG. 18 is a perspective view of a surface cleaner according to another embodiment
Figure 19:
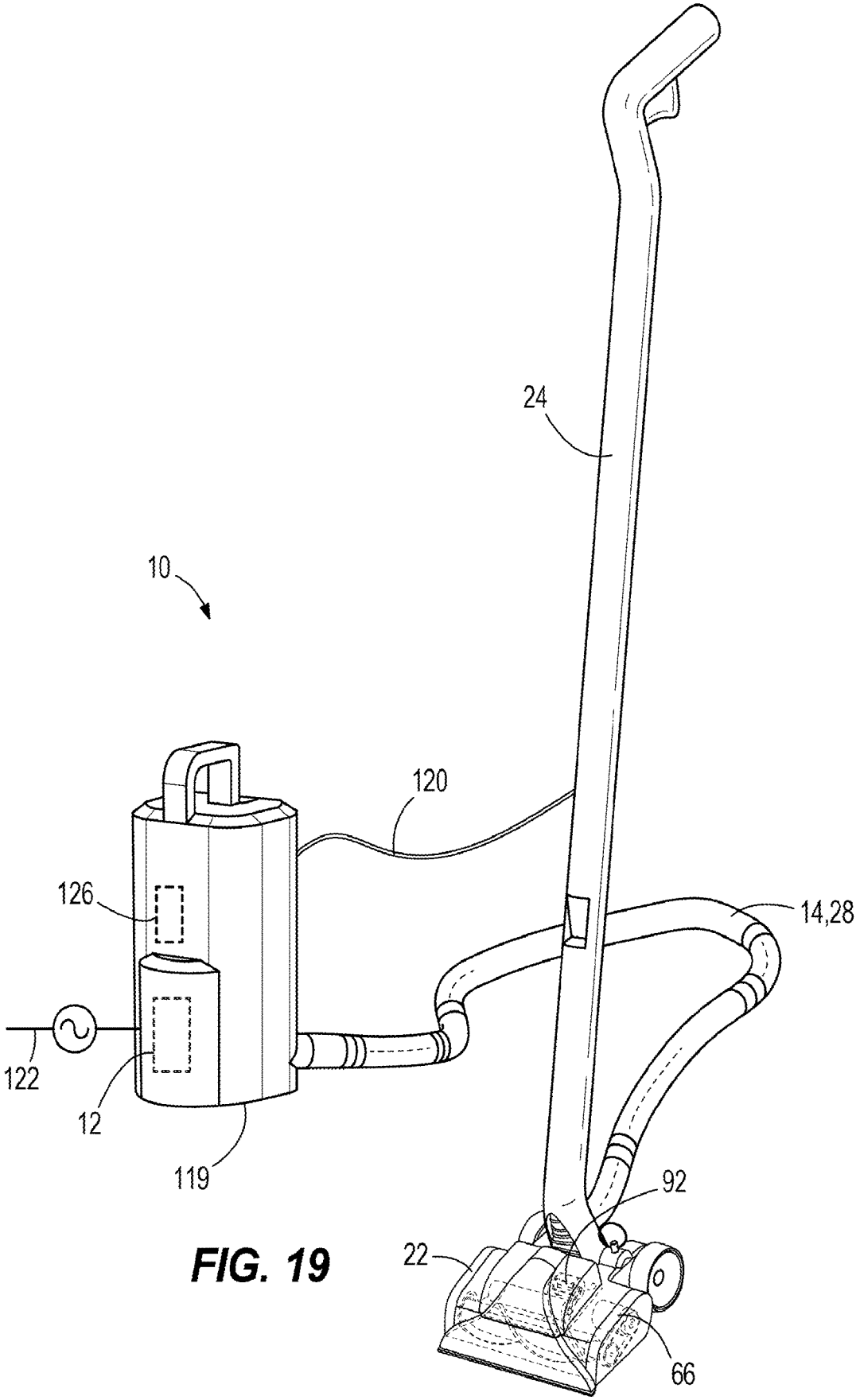
FIG. 19 is a perspective view of a surface cleaner according to another embodiment.

In one embodiment illustrated in FIG. 12, the surface cleaner 10 includes a removable canister 119 that includes the suction source 12 (reference numbers used refer to like feature illustrated in FIGS. 1-10 and described above). The canister assembly 119 is removably coupled to the upright portion 24. The canister assembly 119 includes the suction source 12 configured to generate the suction airflow along the airpath between the suction inlet 16 and the air exhaust 18. The canister assembly 119 also includes the collection container 20 along the airpath in communication with the suction inlet 16 and the suction source 12. In the embodiment of FIG. 12, cleaner 10 includes the fluid distribution system 34 and the collection container 20 is a recovery tank. In one embodiment, the fluid distribution system 34 includes a fluid passageway extending along or inside of the conduit 38 for delivering fluid to the base 22. The conduit 28 is connected to the canister assembly 119 in fluid communication with the collection container 20 along the airflow path 14. Referring to FIGS. 18 and 11, in such an embodiment with the canister assembly 119, the surface cleaner 10 includes an electrical connection 120 that provides power from the canister assembly 119 to the agitator drive 66 of the base 22. In the embodiment shown in FIG. 18, the electrical connection 120 is a direct connection between the canister assembly 119 and the upright portion 24 such that the power to the agitator drive 66 is provided from the canister assembly 119 when the canister assembly is docked on the upright portion. In the embodiment shown in FIG. 19, the electrical connection 120 is a tether between the canister assembly 119 and the upright portion 24 such that the power to the agitator drive 66 is provided from the canister assembly 119 whether the canister assembly is docked or undocked. In one embodiment, the power source 122 of the cleaner is an AC power source such as household electricity. In one embodiment, the power source 122 includes one or more battery packs disposed on the cleaner to power all of the cleaner or specific components of the cleaner such as the accessory agitator drive 92, the base agitator drive 66, or other components. The surface cleaner including the canister assembly 119 can used any of the bases 22 described above.

Figure 10A:
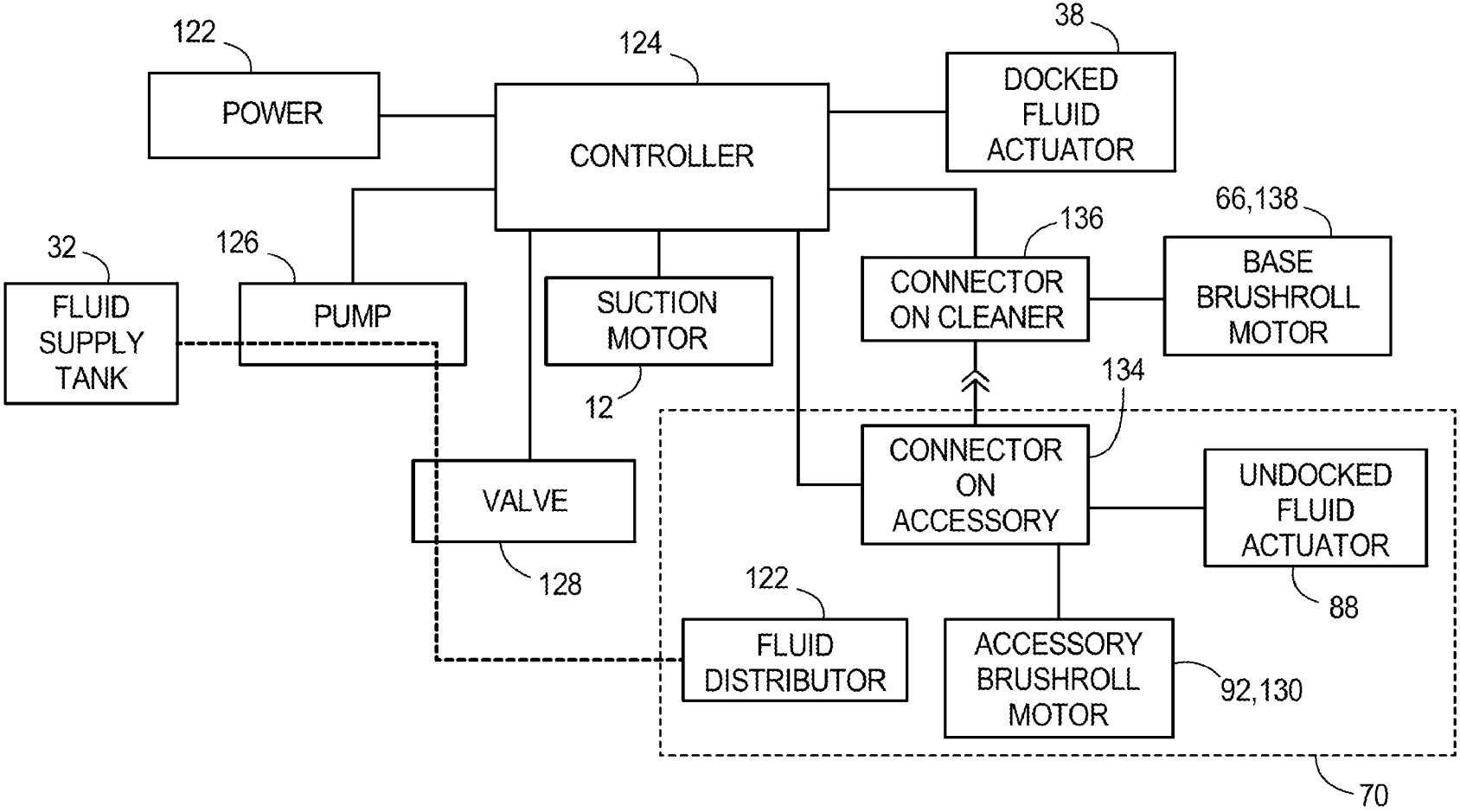
FIG. 10A is a diagram of the floor cleaner of FIG. 10.
Figure 11A:
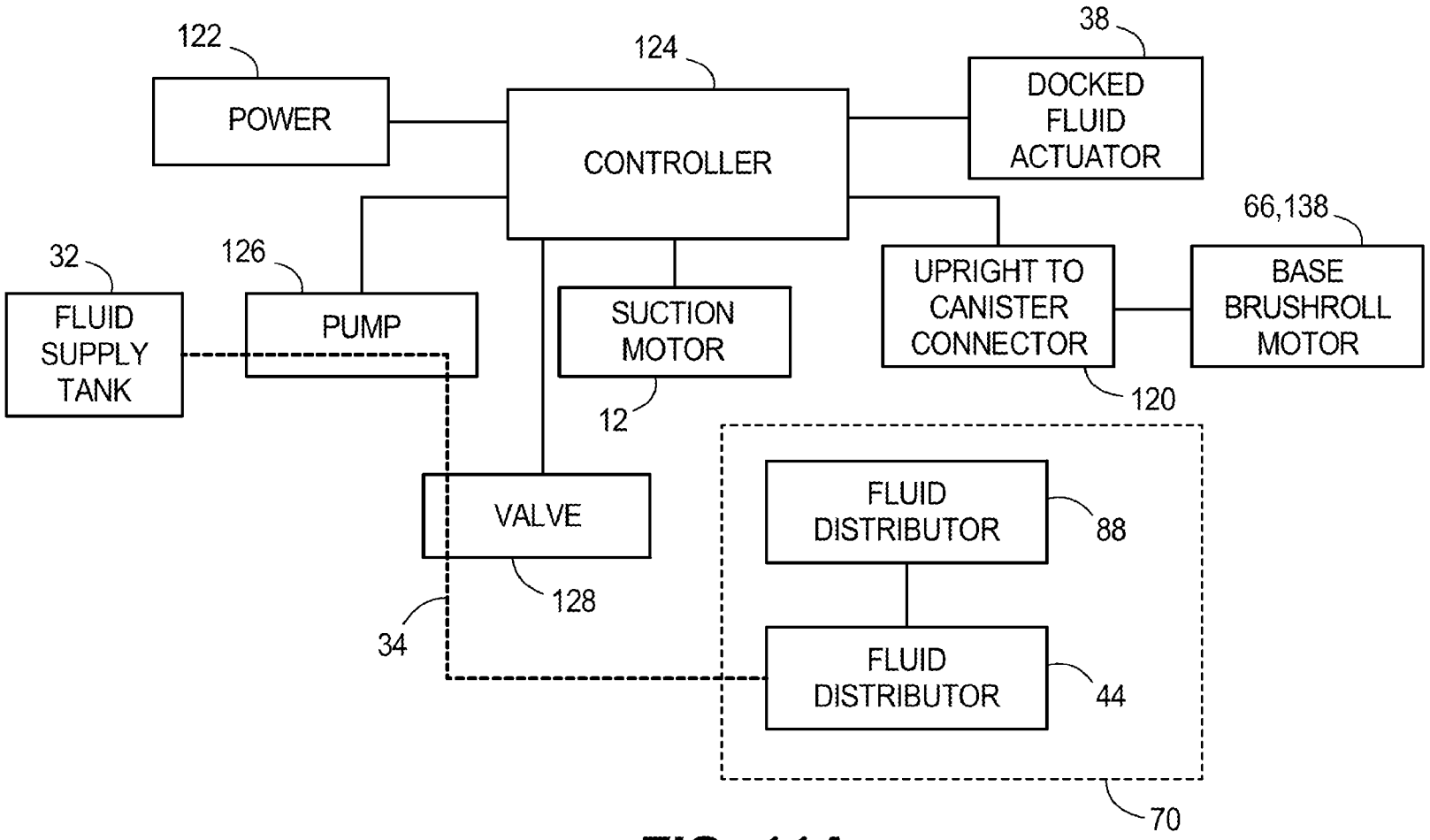
FIG. 11A is a diagram of the floor cleaner of FIG. 11.
Figure 17:
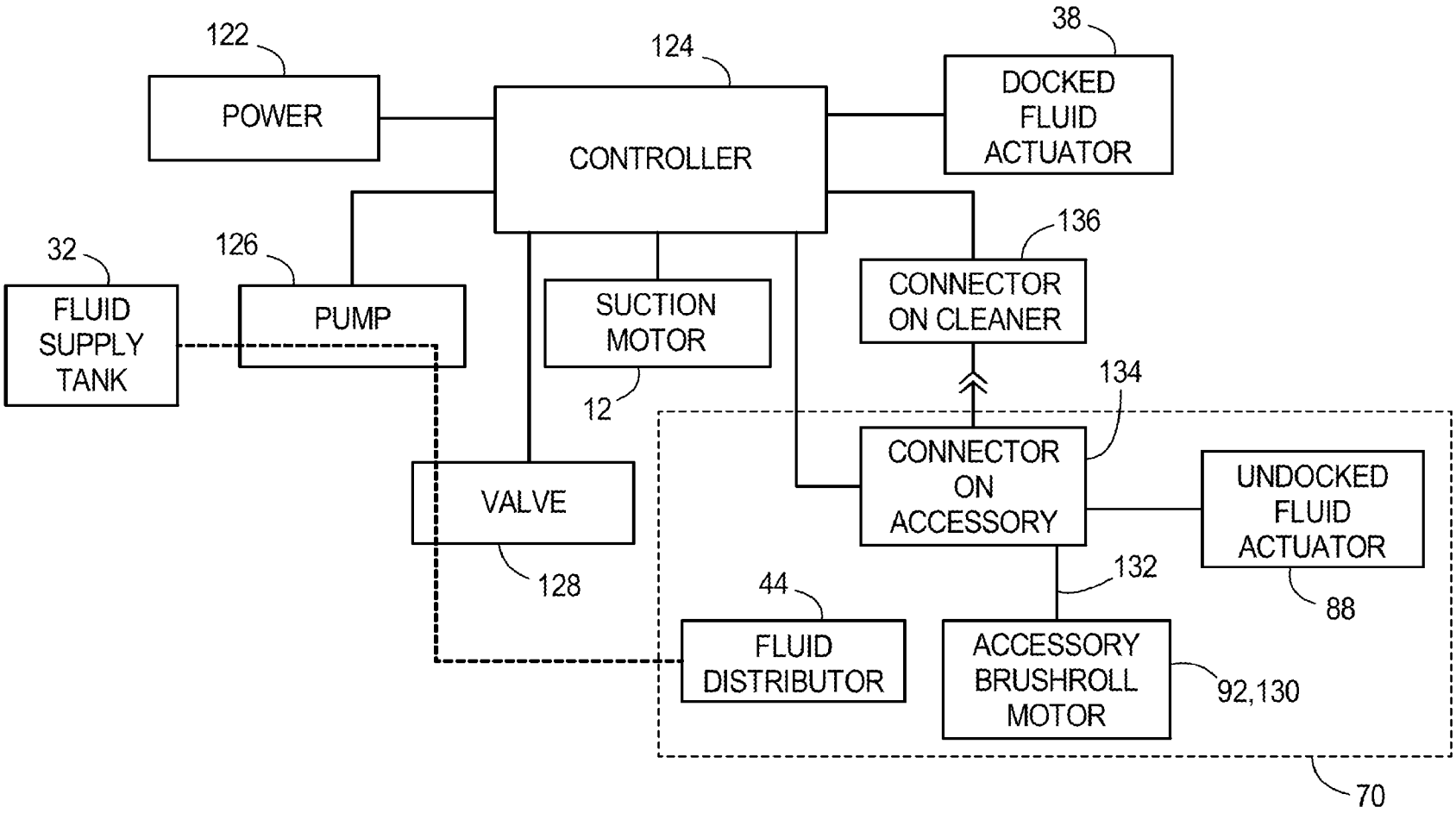
FIG. 17 is a diagram of a surface cleaner including the base of FIG. 13.

FIGS. 10A, 11A, and 17 illustrate diagrams for surface cleaners including the features described above and the agitator drive 66 includes a brushroll motor 138 to operate the agitator 64. FIGS. 11 and 11A illustrates an example wiring and fluid diagram for the surface cleaners 10 of FIGS. 3-7 that include accessory tools 70 having a turbine driven agitator 90. In the embodiments of FIGS. 11 and 11A, cleaner 10 incudes a controller 124 operable to control the suction motor 12 and other operating components of the cleaner. The fluid distribution system 34 includes a pump 126 and/or a valve 128. The controller 124 controls the pump 126 and/or the valve 128 based on a signal or other controller input generated by user actuation of the docked fluid actuator 38 to initiate fluid delivery from the supply tank 32 through the fluid distributor 44. When the accessory body is uncoupled from the base 22, the undocked fluid actuator 88 is accessible to the user for actuating fluid delivery. In the embodiments of FIGS. 11 and 11A, the undocked fluid actuator 88 operates a valve to open and close the fluid passageway from the pump 126 and/or the valve 128.

FIGS. 10 and 10A illustrate diagrams for an alternative embodiment of the surface cleaner where the accessory agitator 90 is driven by an accessory agitator drive 92 having an electric motor 130 rather than an air turbine or manual actuation. In the embodiment of FIG. 10, power and control is provided to the motor 130 through wiring 132 that extends along or through the conduit 28. The accessory body 70 includes an electrical connector 134 that mates with an electrical connector 136 of the base 22 when the accessory body 70 is coupled to the base 22. Connection of the electrical connectors 134, 136 provides power and control to the motor 138 of the agitator drive 66 through the wiring 132.

FIG. 17 illustrates an example wiring and fluid diagram for the surface cleaners 10 of FIGS. 13-16 where the accessory agitator drive 92 operates both the base agitator 64 and the accessory agitator 90.

Although the invention has been described in detail with reference to certain preferred embodiments, variations and modifications exist within the scope and spirit of one or more independent aspects of the invention as described.

What is claimed is:

1. A surface cleaner comprising:

a suction source configured to generate a suction airflow along an airpath between a suction inlet and an air exhaust;

a collection container along the airpath in communication with the suction inlet and the suction source;

a base movable along a surface to be cleaned, the base including a nozzle forming the suction inlet;

an accessory body removably coupled to the base;

an accessory agitator disposed on the accessory body;

a conduit between the nozzle and the collection container along the airflow path;

an upright portion pivotally coupled to the base;

the nozzle having a first nozzle portion having a first nozzle passageway attached to the base and a second nozzle portion having a second nozzle passageway attached to the accessory body and removable with the accessory body;

the first nozzle portion and the second nozzle portion releasably coupled connecting the first and second nozzle passageways along the airpath in fluid communication with the collection container when the accessory body is coupled to the base;

a supply tank configured to contain a cleaning solution;

a fluid distribution system having a fluid distributor disposed on the accessory body in fluid communication with the supply tank, the fluid distributor configured to selectively deliver fluid from the supply tank to the surface to be cleaned;

a first actuator configured to initiate fluid delivery through the fluid distributor while the accessory body is coupled to the base and the first actuator is actuated;

a second actuator configured to initiate fluid delivery through the fluid distributor while the accessory body is uncoupled from the base and the second actuator is actuated;

wherein the first nozzle passageway forms the suction inlet when the accessory body is coupled to the base; and wherein the second nozzle passageway forms the suction inlet in communication with the collection container and the suction source when the accessory body is uncoupled from the base.

2. The surface cleaner of claim 1, wherein the conduit is connected to the accessory body.

3. The surface cleaner according to claim 1, wherein the collection container is configured to store liquid drawn through the suction inlet.

4. The surface cleaner according to claim 1, further comprising an agitator operatively positioned in the base configured to agitate the surface to be cleaned; and an agitator drive configured to operate the agitator.

5. The surface cleaner according to claim 1, the base including a forward side, a rearward side, an upper side, a lower side, a first lateral side and a second lateral side, the base having a recess on at least one of the forward side and the upper side, wherein the accessory body is disposed in the recess when the accessory body is coupled to the base.

6. The surface cleaner according to claim 1, wherein the accessory agitator is removable with the accessory body from the base and operable when the accessory body is uncoupled from the base, the surface cleaner further comprising, an accessory agitator drive configured to operate the accessory agitator when the accessory body is uncoupled from the base.

7. The surface cleaner of claim 6, wherein the accessory agitator drive includes an air-driven turbine along a turbine airpath having a turbine air inlet and a turbine air outlet, the turbine air outlet being fluidly connected to an airflow path and suction source, wherein the turbine air inlet is open when the accessory body is uncoupled from the base and the turbine air inlet is closed when the accessory body is coupled to the base.

8. The surface cleaner of claim 7, wherein a portion of the base covers the turbine air inlet when the accessory body is coupled to the base closing the turbine air inlet.

9. The surface cleaner of claim 6, further comprising an agitator operatively positioned in the base configured to agitate the surface to be cleaned, the agitator positioned coaxially with the accessory agitator and releasably coupled with the accessory agitator, and wherein the accessory agitator drive is configured to operate the agitator and the accessory agitator when the accessory body is coupled to the base.

10. The surface cleaner according to claim 1, the surface cleaner including a canister assembly removably coupled to the upright portion, the canister assembly including the suction source configured to generate the suction airflow along the airpath between the suction inlet and the air exhaust; and the collection container along the airpath in communication with the suction inlet and the suction source;

the conduit connected to the canister assembly in fluid communication with the collection container along the airflow path.

11. The surface cleaner of claim 10, the canister assembly electrically connected to the upright portion by a tether.

12. The surface cleaner of claim 1, further comprising a gasket between the first nozzle portion and the second nozzle portion.

13. The surface cleaner of claim 1, wherein the base includes a centrifugal nozzle and the centrifugal nozzle forms the suction inlet of the first nozzle passageway when the accessory body is coupled to the base.

14. A surface cleaner comprising:

a suction source configured to generate a suction airflow along an airpath between a suction inlet and an air exhaust;

a collection container along the airpath in communication with the suction inlet and the suction source;

a base movable along a surface to be cleaned, the base including a nozzle forming the suction inlet;

a conduit between the nozzle and the collection container along the airpath;

an upright portion pivotally coupled to the base;

a supply tank configured to contain a cleaning solution;

a fluid distribution system having a fluid port disposed on the base in fluid communication with the supply tank configured to selectively deliver fluid from the supply tank;

an actuator configured to initiate fluid delivery through the fluid port;

the base including a first accessory body removably coupled to the base, the first accessory body including a first fluid distributor releasably coupled to the fluid port configured to deliver fluid to the surface to be cleaned when the first accessory body is coupled to the base;

the nozzle having a first nozzle portion having a first nozzle passageway attached to the base and a second nozzle portion having a second nozzle passageway attached to the first accessory body and removable with the first accessory body;

the first nozzle portion and second nozzle portion releasably coupled connecting the first and second nozzle passageways along the airpath in fluid communication with the collection container when the first accessory body is coupled to the base;

the base including a second accessory body, the second accessory body having a third nozzle portion having a third nozzle passageway and a second fluid distributor;

the second accessory body releasably couplable to the base to couple the second fluid distributor to the fluid port when the first accessory body is uncoupled, connecting the first and third nozzle passageways along the airpath in fluid communication with the collection container when the second accessory body is coupled to the base.

15. The surface cleaner of claim 14, further comprising an agitator operatively positioned in the base configured to agitate the surface to be cleaned; and an agitator drive configured to operate the agitator.

16. The surface cleaner of claim 15, wherein the agitator is disposed on the first accessory body configured to agitate the surface to be cleaned when the first accessory body is coupled to the base.

17. A surface cleaner comprising:

a suction source configured to generate a suction airflow along an airpath between a suction inlet and an air exhaust;

a collection container along the airpath in communication with the suction inlet and the suction source;

a base movable along a surface to be cleaned, the base including a nozzle forming the suction inlet;

an accessory body removably coupled to the base;

a conduit between the nozzle and the collection container along the airflow path;

an upright portion pivotally coupled to the base;

the nozzle having a first nozzle portion having a first nozzle passageway attached to the base and a second nozzle portion having a second nozzle passageway attached to the accessory body and removable with the accessory body;

the first nozzle portion and the second nozzle portion releasably coupled connecting the first and second nozzle passageways along the airpath in fluid communication with the collection container when the accessory body is coupled to the base;

wherein the first nozzle passageway forms the suction inlet when the accessory body is coupled to the base; and wherein the second nozzle passageway forms the suction inlet in communication with the collection container and the suction source when the accessory body is uncoupled from the base, the surface cleaner further comprising, a supply tank configured to contain a cleaning solution;

a fluid distribution system having a fluid distributor disposed on the accessory body, and in fluid communication with the supply tank, the fluid distributor configured to selectively deliver fluid from the supply tank to the surface to be cleaned;

a first actuator configured to initiate fluid delivery through the fluid distributor, such that the fluid distributor configured to deliver fluid to the surface to be cleaned when the accessory body is coupled to the base and the first actuator is actuated; and a second actuator configured to initiate fluid delivery through the fluid distributor, such that the fluid distributor is configured to dispense fluid when the accessory body is uncoupled from the base and the second actuator is actuated.

* * * * *